US012202691B2

(12) United States Patent
Sugai et al.

(10) Patent No.: US 12,202,691 B2
(45) Date of Patent: Jan. 21, 2025

(54) SHEET DISCHARGING APPARATUS, SHEET PROCESSING APPARATUS, AND IMAGE FORMING SYSTEM

(71) Applicant: CANON KABUSHIKI KAISHA, Tokyo (JP)

(72) Inventors: Nobutoshi Sugai, Shizuoka (JP); Takuro Mita, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 616 days.

(21) Appl. No.: 17/527,284

(22) Filed: Nov. 16, 2021

(65) Prior Publication Data

US 2022/0162029 A1 May 26, 2022

(30) Foreign Application Priority Data

Nov. 25, 2020 (JP) ..... 2020-195207
Feb. 22, 2021 (JP) ..... 2021-026312
Sep. 27, 2021 (JP) ..... 2021-156756

(51) Int. Cl.
*B65H 29/60* (2006.01)
*B65H 31/30* (2006.01)
*B65H 43/08* (2006.01)

(52) U.S. Cl.
CPC ..... *B65H 29/60* (2013.01); *B65H 31/3081* (2013.01); *B65H 43/08* (2013.01); *B65H 2801/06* (2013.01)

(58) Field of Classification Search
CPC ..... B65H 29/14; B65H 29/20; B65H 29/58; B65H 29/60; B65H 29/125; B65H 31/3081; B65H 31/02; B65H 31/36; B65H 2301/42194; B65H 2405/11151; B65H 2801/27
See application file for complete search history.

(56) References Cited

U.S. PATENT DOCUMENTS 5,112,034 A 5/1992 Uto et al.
7,306,214 B2 12/2007 Iida et al.
7,946,563 B2 * 5/2011 Fukasawa ..... G03G 15/6582 270/32

(Continued)

FOREIGN PATENT DOCUMENTS

JP H06-99070 B2 12/1994
JP 2003-267616 A 9/2003

(Continued)

*Primary Examiner* — Leslie A Nicholson, III
(74) *Attorney, Agent, or Firm* — Venable LLP

(57) ABSTRACT

A sheet discharging apparatus includes a stacking portion, a first conveyance portion, a detection portion, a second conveyance portion, a third conveyance portion, and a control portion. The control portion is configured to execute a discharge operation by causing the sheet discharging apparatus to reverse a conveyance direction of a first sheet conveyed from the first conveyance portion to the second conveyance portion and deliver the first sheet to the third conveyance portion by using the second conveyance portion, convey the first sheet toward the second conveyance portion by the third conveyance portion, and discharge the first sheet and the second sheet to the stacking portion by using the second conveyance portion in a state where the first sheet and the second sheet are superimposed on each other.

14 Claims, 9 Drawing Sheets

(56) References Cited

U.S. PATENT DOCUMENTS

| | | | | |
|---|---|---|---|---|
| 7,975,999 | B2 * | 7/2011 | Fukasawa | B65H 37/04 270/32 |
| 8,511,665 | B2 * | 8/2013 | Iwata | B65H 29/6645 271/286 |
| 9,329,555 | B2 * | 5/2016 | Motoi | B65H 35/04 |
| 9,988,231 | B2 * | 6/2018 | Nakano | B65H 29/54 |
| 10,315,880 | B2 * | 6/2019 | Nakano | B65H 29/145 |
| 10,464,772 | B2 * | 11/2019 | Saito | B42C 19/08 |
| 11,230,454 | B2 * | 1/2022 | Haruna | B65H 33/08 |
| 11,353,817 | B2 * | 6/2022 | Agata | B65H 31/36 |
| 11,518,638 | B2 * | 12/2022 | Yamano | B65H 29/60 |
| 11,649,133 | B2 * | 5/2023 | Sato | G03G 15/6541 270/58.17 |
| 11,772,926 | B2 * | 10/2023 | Yamano | B65H 31/3081 270/58.08 |
| 11,987,466 | B2 * | 5/2024 | Izaki | B26F 1/06 |

FOREIGN PATENT DOCUMENTS

| | | | |
|---|---|---|---|
| JP | 2005-060106 | A | 3/2005 |
| JP | 2008-207957 | A | 9/2008 |
| JP | 2018-047964 | A | 3/2018 |

* cited by examiner

SHEET DISCHARGING APPARATUS, SHEET PROCESSING APPARATUS, AND IMAGE FORMING SYSTEM

BACKGROUND OF THE INVENTION

Field of the Invention

The present invention relates to a sheet discharging apparatus that discharges sheets, a sheet processing apparatus that performs processes on sheets, and an image forming system that forms images on sheets.

Description of the Related Art

A known image forming system includes a sheet processing apparatus (referred to also as a finisher) that performs processes, such as sort process, binding process, or alignment process, on sheets on which images have been formed. The sheet processing apparatus is available as an option of an image forming apparatus, such as an electrophotographic copying machine or a laser beam printer. In a case where the sheet processing apparatus performs a process on a plurality of sheet bundles successively, if the sheet processing apparatus temporarily stops receiving a sheet from the image forming apparatus until the sheet processing apparatus completes to perform the process on a preceding sheet bundle, the productivity (throughput) of the image forming system will decrease.

As countermeasures, in a known method, while a process is performed on a sheet bundle, one or more sheets received from an image forming apparatus are temporarily held or buffered in a sheet processing apparatus while being superimposed on one another, and the sheets are then stacked, as a sheet bundle, on a processing tray after the process for the preceding sheet bundle is completed. Japanese Examined Patent Application Publication No. H06-099070 describes a configuration in which two sheets received from an image forming apparatus are held by using two conveyance paths that are branched from each other in a finisher. The two sheets are then discharged onto a processing tray with one sheet stacked on the other.

By the way, if the sheet conveyance speed is increased for further increasing the productivity of the image forming system, sheets will be discharged, with great force, from the image forming apparatus or the sheet processing apparatus. As a result, the stacking position of sheets discharged onto a destination, such as a discharging tray, to which the sheets are discharged tends to be easily changed disadvantageously.

SUMMARY OF THE INVENTION

The present invention provides a sheet discharging apparatus, a sheet processing apparatus and an image forming system that can improve sheet stacking performance while keeping productivity.

According to one aspect of the invention, a sheet discharging apparatus includes a stacking portion on which a sheet is stacked, a first conveyance portion that is disposed on a first conveyance path extending toward the stacking portion and that is configured to convey a sheet toward the stacking portion, a detection portion configured to output a detection signal in response to a sheet that is passing through the first conveyance path, a second conveyance portion disposed downstream of the first conveyance portion in the first conveyance path and configured to reverse a conveyance direction of a sheet that the second conveyance portion has received from the first conveyance portion and convey the sheet to a second conveyance path, the second conveyance path being a path branched from a portion of the first conveyance path between the first conveyance portion and the second conveyance portion, a third conveyance portion disposed on the second conveyance path and configured to reverse a conveyance direction of a sheet and convey the sheet, and a control portion configured to control the first conveyance portion, the second conveyance portion, and the third conveyance portion, the control portion being configured to execute a discharge operation by causing the sheet discharging apparatus to reverse a conveyance direction of a first sheet conveyed from the first conveyance portion to the second conveyance portion and deliver the first sheet to the third conveyance portion by using the second conveyance portion, convey the first sheet toward the second conveyance portion by the third conveyance portion, depending on the detection signal outputted by the detection portion in response to a second sheet that is conveyed following the first sheet, and discharge the first sheet and the second sheet to the stacking portion by using the second conveyance portion in a state where the first sheet and the second sheet are superimposed on each other such that an edge portion of the first sheet in the conveyance direction thereof and an edge portion of the second sheet in a conveyance direction thereof are aligned with each other.

Further features of the present invention will become apparent from the following description of exemplary embodiments with reference to the attached drawings.

DESCRIPTION OF THE EMBODIMENTS

Hereinafter, some embodiments of the present disclosure will be described with reference to the accompanying drawings.

First Embodiment

Figure 1:
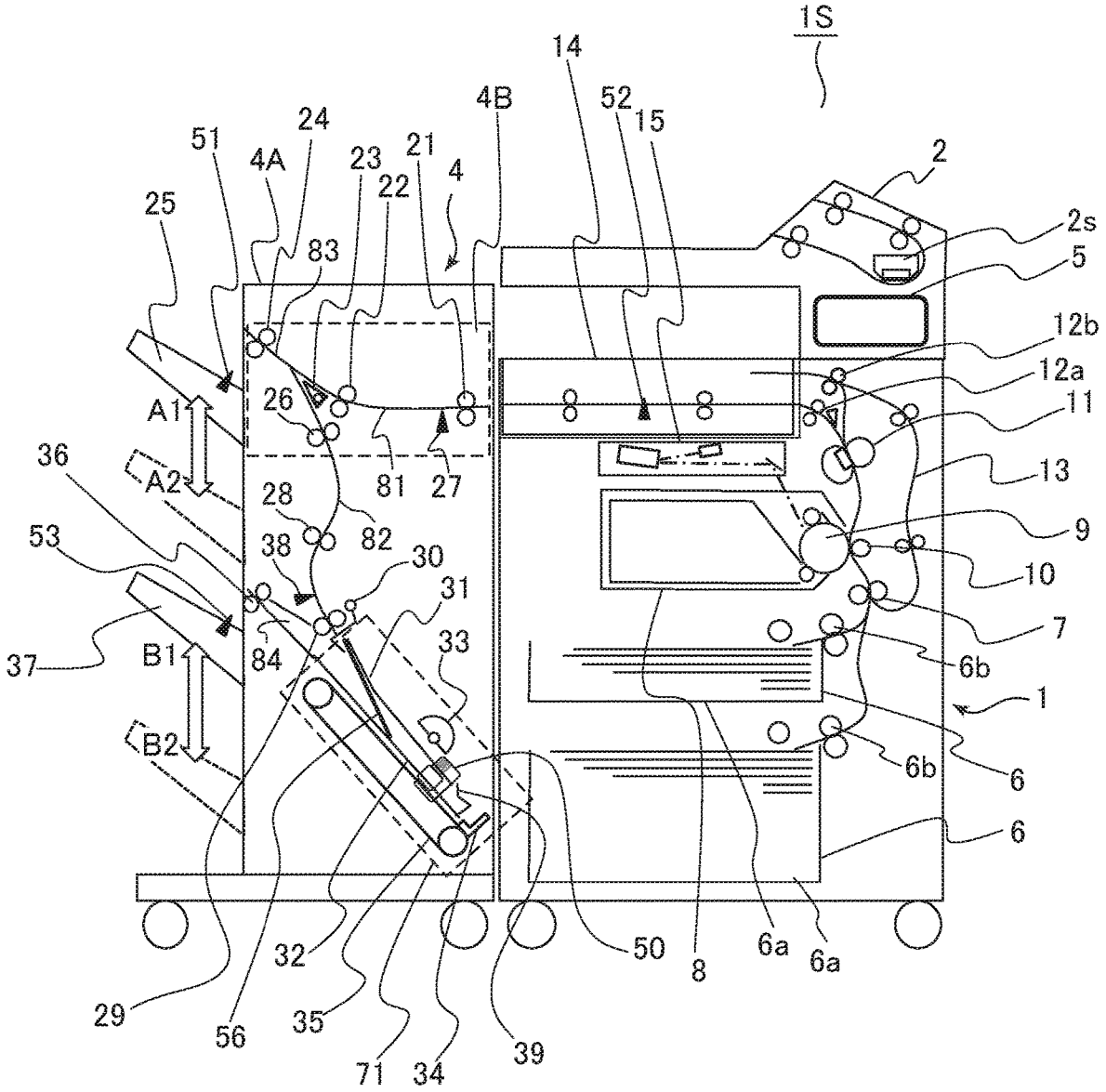
FIG. 1 is a schematic diagram of an image forming system of a first embodiment of the present disclosure.

FIG. 1 is a schematic diagram of an image forming system 1S of a first embodiment, viewed from the front side of the image forming system 1S. The image forming system 1S includes an image forming apparatus 1 that forms an image on a sheet, a sheet processing apparatus 4 that performs processes on the sheet on which the image is formed by the image forming apparatus 1, a relay unit 14 that conveys the sheet from the image forming apparatus 1 to the sheet processing apparatus 4, and an image reading apparatus 2. The sheet, which is a recording material, may be a paper sheet, such as a plain paper sheet or a thick paper sheet, a plastic film, a cloth sheet, a sheet material, such as a coated paper sheet, on which certain surface treatment has been performed, a specially-shaped sheet material, such as an envelope or an index paper sheet, or any one of a variety of sheets having different sizes and materials. Hereinafter, the operation of each component of the image forming system 1S will be described simply, and after that, the operation of the sheet processing apparatus 4 will be described in detail.

The image forming apparatus 1 includes an electrophotographic image forming portion 8 that serves as an image forming portion, and feeding apparatuses 6 that feed sheets to the image forming portion 8 one by one. The image forming portion 8 is a cartridge in which a photosensitive drum 9, a charger, and a development unit are disposed as one body. The photosensitive drum 9 is an image bearing member (i.e., a photoreceptor in electrophotography). The charger and the development unit perform electrophotographic processes on the photosensitive drum 9. In addition, a scanner unit 15 is disposed, as an exposing portion, above the image forming portion 8; and a transfer roller 10 is disposed, as a transfer portion, at a position that faces the photosensitive drum 9. In addition, above the transfer roller 10, a fixing apparatus 11, a discharging roller 12*a*, and a reversing roller 12*b* are disposed. The fixing apparatus 11 adopts a heat fixing system, and may include a cylindrical film, a heater unit, and a pressing roller. The heater unit has a heater, and is disposed inside the film. The pressing roller is in pressure contact with the heater via the film.

Below the image forming portion 8, the plurality of feeding apparatuses 6 are disposed for feeding sheets. Each of the feeding apparatuses 6 includes a cassette 6*a* and a feeding unit 6*b*. The cassette 6*a* serves as a storage portion or sheet storage that stores a plurality of sheets, and the feeding unit 6*b* feeds the sheets one by one from the cassette 6*a*.

In the image forming portion 8, when the image forming apparatus 1 performs an image forming operation, the charger uniformly charges the surface of the photosensitive drum 9, and the scanner unit 15 forms an electrostatic latent image on the surface of the photosensitive drum 9 in accordance with image information, by emitting a laser beam to the surface of the photosensitive drum 9. The electrostatic latent image is then developed (i.e., visualized) with toner supplied from the development unit and serving as developer, so that a toner image is formed on the surface of the photosensitive drum 9.

In parallel with the operation of the image forming portion 8, sheets are conveyed one by one from the cassette 6*a* of any one of the feeding apparatuses 6 toward a registration roller 7 by the feeding unit 6*b*. The registration roller 7 corrects the skew of the sheet; and then sends the sheet to a transfer portion between the photosensitive drum 9 and the transfer roller 10, in synchronization with the formation of the toner image performed by the image forming portion 8. In the transfer portion, the toner image is transferred from the photosensitive drum 9 onto the sheet.

The sheet that has passed through the transfer portion is sent to the fixing apparatus 11. In the fixing apparatus 11, the toner on the sheet is heated and pressed while the sheet passes through a fixing nip portion (which is a nip portion between the heater unit and the pressing roller) in a state where the sheet is nipped by the film and the pressing roller. In this operation, the toner image is fixed to the sheet.

If the single-side printing is performed, the sheet that has passed through the fixing apparatus 11 is discharged from the image forming apparatus 1 by the discharging roller 12*a*, and received by the relay unit 14. If the double-side printing is performed, the sheet having the toner image formed on a first surface and having passed through the fixing apparatus 11 is guided to the reversing roller 12*b*. The sheet is then switch-backed by the reversing roller 12*b*, and conveyed to the registration roller 7 again through a reconveyance path 13. Then the sheet passes through the transfer portion and the fixing apparatus 11, so that an image is formed on a second surface of the sheet, which is opposite to the first surface. After that, the sheet is delivered to the relay unit 14 by the discharging roller 12*a*.

The image reading apparatus 2 is disposed above the image forming apparatus 1. The image reading apparatus 2 includes a reading sensor 2*s* and a document conveyance portion. The reading sensor 2*s* reads image information from a document sheet, and the document conveyance portion conveys document sheets one by one to the reading sensor 2*s*. The image forming apparatus 1 can perform both of copying operation and printing operation. In the copying operation, the image forming apparatus 1 forms an image in accordance with the image information obtained by the image reading apparatus 2. In the printing operation, the image forming apparatus 1 forms an image in accordance with the image information that the image forming apparatus 1 has received from an external apparatus.

In the present embodiment, the relay unit 14 is disposed in a space (referred to also as an in-body discharging space) between the image forming apparatus 1 and the image reading apparatus 2 in an up-and-down direction (i.e., vertical direction obtained when the image forming system 1S is placed on a horizontal plane). The relay unit 14 conveys the sheet, discharged from the image forming apparatus 1, toward the sheet processing apparatus 4 in a direction that is substantially horizontal when viewed from the front side of the image forming system 1S. The sheet processing apparatus 4 is disposed adjacent to the image forming apparatus 1, on a plane on which the image forming apparatus 1 is disposed. In the relay unit 14, a sheet sensor 52 is disposed as a detection portion that detects a sheet that is passing through the relay unit 14. For example, the sheet sensor 52 is a reflective photosensor that detects a sheet by emitting infrared light to the conveyance path and detecting the light reflected by the sheet that is passing through the conveyance path. Note that although the image forming system 1S includes the relay unit 14, as an example, in the present embodiment, the sheet may be delivered from the image forming apparatus 1 directly to the sheet processing apparatus 4.

The image forming apparatus 1 also includes a display portion 5 (also known as operation portion, operation-and-display portion) that is a user interface of the image forming system 1S. The display portion 5 has a function to display an operation state of the system, such as jam or failure, and an operation required to a user, such as replacement of consumables used in the apparatus or removal of jammed sheets. The user can perform various types of setting and instructions on the image forming system 1S, by operating a touch-panel function or a ten-key numeric keypad function of the display of the display portion 5.

Note that the system of the image forming apparatus may not be the direct-transfer system illustrated in FIG. 1. For example, the system of the image forming apparatus may be an intermediate transfer system in which a toner image formed by the image forming portion is transferred onto a sheet via an intermediate transfer member. In another case, the image forming apparatus may be a color-image forming apparatus that uses a plurality of image forming portions. In addition, the image forming mechanism may not be the electrophotographic system. For example, the image forming mechanism may use an ink-jet printing unit, or may be an offset-printing mechanism.

Sheet Processing Apparatus

The sheet processing apparatus 4 includes a sheet processing portion 71 that performs processes on sheets. The sheet processing apparatus 4 has a function that receives sheets from the image forming apparatus 1, then performs the processes on the sheets, and discharges the sheets as a product. The sheet processing apparatus 4 can receive sheets from the image forming apparatus 1; and discharge the sheets as products, without performing the processes on the sheets.

In the sheet processing apparatus 4, a receiving path 81, an inner discharge path 82, a first discharging path 83, and a second discharging path 84 are disposed as conveyance paths that convey sheets. In addition, in the sheet processing apparatus 4, an upper discharging tray 25 and a lower discharging tray 37 that project from an apparatus body 4A to the outside are disposed as destinations to which the sheets are discharged. The apparatus body 4A is a housing in which the receiving path 81, the inner discharge path 82, the first discharging path 83, and the second discharging path 84 are disposed. The receiving path 81 is a conveyance path for receiving a sheet from the image forming apparatus 1 and conveying the sheet. The inner discharge path 82 is a conveyance path for conveying a sheet toward the sheet processing portion 71. The first discharging path 83 is a conveyance path for discharging a sheet to the upper discharging tray 25. The second discharging path 84 is a conveyance path for discharging a sheet to the lower discharging tray 37. In the present embodiment, the receiving path 81 and the first discharging path 83 serve as a first conveyance path that extends toward the upper discharging tray 25 that serves as a stacking portion (first stacking portion), and the inner discharge path 82 serves as a second conveyance path that is branched from the first conveyance path. The second discharging path 84 serves as a third conveyance path that extends from the sheet processing portion 71 toward the lower discharging tray 37, which serves as a second stacking portion.

On the receiving path 81, an inlet roller 21, a pre-branch roller 22, and an inlet sensor 27 are disposed. On the first discharging path 83, a discharge-and-reverse roller 24 is disposed as a reverse-and-conveyance unit. On the inner discharge path 82, an inner discharge roller 26, an intermediate conveyance roller 28, a kickout roller 29, and a pre-intermediate stacking sensor 38 are disposed. On the second discharging path 84, a bundle discharge roller 36 is disposed. The pre-branch roller 22 is a first conveyance portion of the present embodiment, the discharge-and-reverse roller 24 is a second conveyance portion of the present embodiment, and the inner discharge roller 26 is a third conveyance portion of the present embodiment. Each of the inlet roller 21, the pre-branch roller 22, the discharge-and-reverse roller 24, the inner discharge roller 26, the intermediate conveyance roller 28, the kickout roller 29, and the bundle discharge roller 36 is a roller pair. The outer circumferential surface of one element of the roller pair and the outer circumferential surface of the other element of the roller pair abut against each other, and thereby form a nip portion through which a sheet is conveyed while nipped by the roller pair.

Each of the inlet sensor 27 and the pre-intermediate stacking sensor 38 is an example of detection portions, which detection portion is disposed at a predetermined detection position in a conveyance path of the sheet processing apparatus and detects a sheet that is passing through the conveyance path, at the detection position (that is, the sensor outputs a detection signal in response to the sheet that is passing through the conveyance path). For example, each of the inlet sensor 27 and the pre-intermediate stacking sensor 38 is a reflective photosensor that detects a sheet by emitting infrared light to the conveyance path and detecting the light reflected by the sheet that is passing through the conveyance path. In another case, the sheet detection portion may be constituted by a flag that projects in the conveyance path and a photoelectric sensor such as a photointerrupter. In this case, the flag is pivoted when a sheet abuts against the flag, and the pivot of the flag is detected by the photoelectric sensor.

Hereinafter, the sheet conveyance path in the sheet processing apparatus 4 will be described. A sheet that has been conveyed from the image forming apparatus 1 through the relay unit 14 is received by the inlet roller 21 of the sheet processing apparatus 4, and then is conveyed to the pre-branch roller 22 through the receiving path 81. The inlet sensor 27 detects the sheet at a detection position between the inlet roller 21 and the pre-branch roller 22. The pre-branch roller 22 receives the sheet from the inlet roller 21, and conveys the sheet toward the first discharging path 83.

Note that at a predetermined timing after the inlet sensor 27 detects the passage of the trailing edge of the sheet, the pre-branch roller 22 increases the conveyance speed of the sheet from a conveyance speed produced by the relay unit 14 to a speed faster than the conveyance speed. In another case, the conveyance speed of the sheet produced by the inlet roller 21 may be set faster than the conveyance speed produced by the relay unit 14, and the conveyance speed of the sheet may be increased by the inlet roller 21 disposed upstream of the pre-branch roller 22. In this case, it is preferable that a one-way clutch is disposed between a conveyance roller of the relay unit 14 and a motor that drives the conveyance roller so that the conveyance roller runs idle when the sheet is pulled by the inlet roller 21.

If the sheet is to be discharged to the upper discharging tray 25, the discharge-and-reverse roller 24 receives the sheet from the pre-branch roller 22, and discharges the sheet to the upper discharging tray 25. In this case, at a predetermined timing after the trailing edge of the sheet passes through the pre-branch roller 22, the discharge-and-reverse roller 24 is decelerated to a predetermined discharge speed.

If the sheet is to be discharged to the lower discharging tray 37, the discharge-and-reverse roller 24 receives the sheet from the pre-branch roller 22, switch-backs the sheet, and conveys the sheet to the inner discharge path 82. That is, the discharge-and-reverse roller 24 first conveys the sheet toward the outside of the sheet processing apparatus 4 in the discharging direction, and then conveys the sheet toward the opposite direction by reversing the rotational direction of the discharge-and-reverse roller 24 before the trailing edge of the sheet in the discharging direction passes through the discharge-and-reverse roller 24. A non-return guide 23 is disposed in a branch portion (between the pre-branch roller 22 and the discharge-and-reverse roller 24), which is located upstream of the discharge-and-reverse roller 24 in the discharging direction and in which the inner discharge path 82 branches from the receiving path 81 and the first discharging path 83. The non-return guide 23 has a function as a guide (regulation member, backflow check valve or one-way guide) that prevents the sheet, switch-backed by the discharge-and-reverse roller 24, from moving backward toward the receiving path 81. In other words, the sheet is switch-backed by the discharge-and-reverse roller 24 by reversing the conveyance direction of the sheet after the trailing edge of the sheet in the discharging direction passes the non-return guide 23.

The inner discharge roller 26, the intermediate conveyance roller 28, and the kickout roller 29, which are disposed on the inner discharge path 82, conveys the sheet sent from the discharge-and-reverse roller 24, toward the sheet processing portion 71 such that the sheet is delivered from one roller to another roller in a sequential manner. The pre-intermediate stacking sensor 38 detects the sheet at a position between the intermediate conveyance roller 28 and the kickout roller 29. For example, the pre-intermediate stacking sensor 38 is a reflective photosensor that detects a sheet by emitting infrared light to the conveyance path and detecting the light reflected by the sheet that is passing through the conveyance path.

The sheet processing apparatus 4 includes a superimposing process portion 4B, which includes the discharge-and-reverse roller 24 and the inner discharge roller 26. The sheet processing apparatus 4 causes the superimposing process portion 4B to superimpose a plurality of sheets conveyed from the image forming apparatus 1 one by one. The superimposing process portion 4B of the present embodiment operates such that the first sheet conveyed through the receiving path 81 is held in the inner discharge path 82 by the discharge-and-reverse roller 24 and the inner discharge roller 26, and that the second sheet conveyed through the receiving path 81 is then superimposed on the first sheet. The superimposing process portion 4B has a function (superimposing-and-discharging function) that discharges the superimposed sheets to the upper discharging tray 25, and a function (buffering function) that conveys the superimposed sheets to the sheet processing portion 71. The detailed configuration and operation of the superimposing process portion 4B will be described later.

The sheet processing portion 71 receives a plurality of sheets from the inner discharge path 82, then aligns the sheets, and then performs a binding process for binding the sheet bundle at a predetermined position. The sheet processing portion 71 includes a stapler 50, an intermediate stacking upper guide 31, and an intermediate stacking lower guide 32. The stapler 50 serves as a processing portion, and the intermediate stacking upper guide 31 and the intermediate stacking lower guide 32 constitute an intermediate stacking portion (i.e., processing tray) in which the sheets to be processed are stacked.

A vertical-alignment reference plate 39 is disposed as a reference member, in the most downstream portion of the sheet processing portion 71 in the conveyance direction of the kickout roller 29. Thus, an edge portion of a sheet in the conveyance direction abuts against the vertical-alignment reference plate 39, so that the position of the sheet bundle in the longitudinal direction (conveyance direction) is aligned. A semicircular roller 33 is disposed downstream of a pressing guide 56, and is rotatably supported by the intermediate stacking upper guide 31.

The semicircular roller 33 is a moving member (which can also be said as paddle member or conveyance member) that causes a sheet that has passed through the kickout roller 29, to abut against the vertical-alignment reference plate 39. Specifically, after the trailing edge of a sheet passes the pre-intermediate stacking sensor 38, the semicircular roller 33 conveys the sheet toward the vertical-alignment reference plate 39 at a predetermined timing. The contact pressure of the semicircular roller 33 to the sheet is set so that the semicircular roller 33 slides on the sheet in a state where the sheet is in contact with the vertical-alignment reference plate 39. Note that the flexible pressing guide 56 is fixed to the intermediate stacking upper guide 31. The pressing guide 56 presses a sheet, located in the sheet processing portion 71, downward with predetermined pressure applying force for preventing the sheet from floating up. In addition, a bundle pressing flag 30 is disposed downstream of the kickout roller 29, and is rotatably supported. The bundle pressing flag 30 prevents the trailing edge of a sheet stacked on the sheet processing portion 71, from rising up so that the trailing edge does not interfere with the leading edge of a following sheet discharged from the kickout roller 29.

When a predetermined number of sheets (i.e., a plurality of sheets to be processed into one copy of product) is aligned in the intermediate stacking portion, the sheets are bound by the stapler 50. Then a bundle discharge guide 34, which serves as a pushing member driven by a guide driving portion 35, pushes the sheet bundle out of the intermediate stacking portion by moving from a wait position illustrated in FIG. 1 toward a direction (bundle discharge direction) that extends toward the bundle discharge roller 36. When the leading edge of the sheet bundle in the bundle discharge direction reaches the bundle discharge roller 36, the bundle discharge guide 34 stops, and then returns to the wait position again. The bundle discharge roller 36, which serves as a discharging portion (fourth conveyance portion), receives the sheet bundle from the bundle discharge guide 34, and discharges the sheet bundle to the lower discharging tray 37.

The upper discharging tray 25 and the lower discharging tray 37 can move vertically with respect to the housing of the sheet processing apparatus 4. In addition, sheet sensors 51 and 53 are respectively disposed on the upper discharging tray 25 and the lower discharging tray 37 for detecting sheets on the trays 25 and 37. Each of the sheet sensors 51 and 53 is a reflective photosensor that detects a sheet by emitting infrared light toward a space above the stacking surface of the tray and detecting the light reflected by the sheet. In addition, the sheet processing apparatus 4 includes a sheet-surface detection sensor that detects a position of the upper surface of sheets (i.e., height of the stack of sheets) stacked on the upper discharging tray 25, and a sheet-surface detection sensor that detects a position of the upper surface of sheets (i.e., height of the stack of sheets) stacked on the lower discharging tray 37.

If a sheet-surface detection sensor detects a sheet, a corresponding upper discharging tray 25 or lower discharging tray 37 moves down in an A2 or B2 direction. If the sheet sensor 51 or 53 detects that the sheets stacked on the upper discharging tray 25 or the lower discharging tray 37 have been removed, the upper discharging tray 25 or the lower discharging tray 37 moves up in an A1 or B1 direction. The lifting-and-lowering control is performed on the upper discharging tray 25 and the lower discharging tray 37 depending on the amount of stacked sheets such that the top surface of sheets stacked on the upper discharging tray 25 is lower in height than the discharge-and-reverse roller 24 in the vertical direction, and that the top surface of sheets stacked on the lower discharging tray 37 is lower in height than the bundle discharge roller 36 in the vertical direction. In the present embodiment, the upper discharging tray 25 that serves as a first stacking portion and the lower discharging tray 37 that serves as a second stacking portion are each driven by a motor. However, each of the upper discharging tray 25 and the lower discharging tray 37 may be moved up and down by an urging portion, such as a spring.

Note that the above-described stapler 50 is one example of the processing portion. As an example, a sort mechanism that performs a sort process or a saddle-stitching binding portion that performs saddle-stitching binding may be disposed as the processing portion.

Superimposing Process Portion

Figure 2:
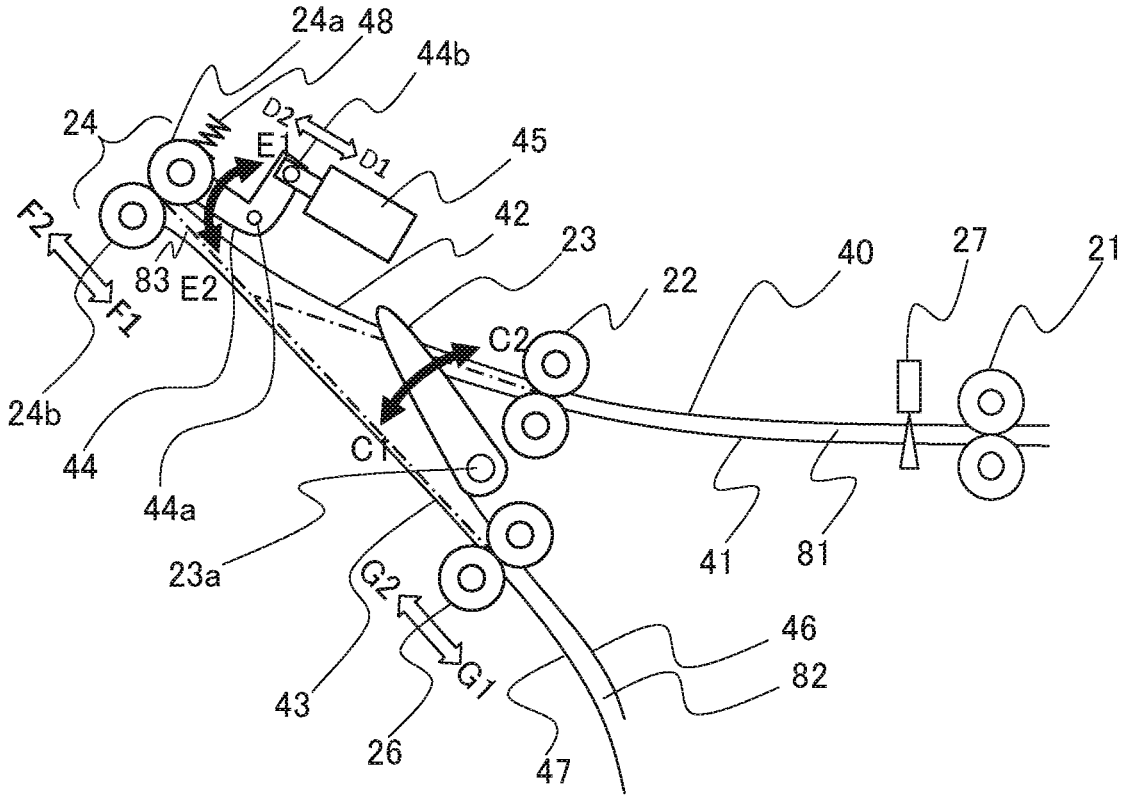
FIG. 2 is a cross-sectional view of a superimposing process portion of the first embodiment.

FIG. 2 is an enlarged view of the superimposing process portion 4B. The sheet conveyance path (receiving path 81) between the inlet roller 21 and the pre-branch roller 22 is formed by an inlet upper guide 40 and an inlet lower guide 41. The sheet conveyance path (inner discharge path 82) between the inner discharge roller 26 and the intermediate conveyance roller 28 is formed by an inner discharge upper guide 46 and an inner discharge lower guide 47. A reverse upper guide 42 is a conveyance guide formed between the pre-branch roller 22 and the discharge-and-reverse roller 24, and formed on the same side as that of the inlet upper guide 40 for guiding sheets. A reverse lower guide 43 is a conveyance guide formed between the discharge-and-reverse roller 24 and the inner discharge roller 26, and formed on the same side as that of the inner discharge lower guide 47 for guiding sheets. Thus, the first discharging path 83 is formed by the reverse upper guide 42 and the reverse lower guide 43.

The sheet conveyed by the inlet roller 21 is guided to the pre-branch roller 22 by the inlet upper guide 40 and the inlet lower guide 41. The inlet sensor 27 is disposed on the inlet upper guide 40. The inlet sensor 27 may be a reflective photosensor that detects a sheet located at the detection position, by emitting infrared light to the receiving path 81 and detecting the light reflected by the sheet. In this case, a hole is formed in a portion of the inlet lower guide 41 that faces the inlet sensor 27, for preventing the infrared light from being reflected when no sheet is passing the inlet sensor 27. The size of the hole is equal to or larger than the diameter of the spot beam from the inlet sensor 27.

The non-return guide 23 is disposed in a portion which is located downstream of the pre-branch roller 22, and in which the receiving path 81 and the inner discharge path 82 branches from the first discharging path 83. The non-return guide 23 is supported such that the non-return guide 23 can rotate with respect to the inner discharge upper guide 46, via a rotation shaft 23*a*. In addition, the non-return guide 23 is always urged by a spring (not illustrated) in a C2 direction (clockwise in FIG. 2) toward a position illustrated in FIG. 2. The position is a position at which the leading edge portion of the non-return guide 23 overlaps with the reverse upper guide 42 when viewed in a direction (i.e., sheet width direction) in which the rotation shaft 23*a* extends. In addition, the spring constant of the above-described spring is set so that when a sheet sent from the pre-branch roller 22 abuts against the non-return guide 23, the non-return guide 23 is pivoted toward a C1 direction (counterclockwise in FIG. 2) against the urging force of the spring. Thus, the non-return guide 23 enables a sheet conveyed from the pre-branch roller 22 toward the discharge-and-reverse roller 24 to pass the non-return guide 23. After the trailing edge of the sheet, conveyed through the receiving path 81, passes the non-return guide 23, the non-return guide 23 pivots in the C2 direction and prevents the sheet from moving backward from the discharge-and-reverse roller 24 to the pre-branch roller 22.

The discharge-and-reverse roller 24 is constituted by an upper roller 24*a* and a lower roller 24*b*. In the present embodiment, each of the upper roller 24*a* and the lower roller 24*b* is applied with driving force, and the rotation of the upper roller 24*a* and the rotation of the lower roller 24*b* are always in synchronization with each other.

The rollers of the discharge-and-reverse roller 24 can be brought into contact with each other (closing operation) and separated from each other (opening operation) by a plunger solenoid 45. Specifically, one end of a separation lever 44 is connected to the roller shaft of the upper roller 24*a*, and the separation lever 44 is supported such that the separation lever 44 can rotate on a lever fulcrum shaft 44*a* with respect to the reverse upper guide 42. A solenoid connection shaft 44*b* connected to the other end of the separation lever 44 is linked with the plunger of the plunger solenoid 45.

When the plunger solenoid 45 is supplied power, the plunger is pulled in a D1 direction by magnetic force, and the separation lever 44 is rotated in an E1 direction. As a result, the discharge-and-reverse roller 24 becomes a separation state (that is, the nip portion of the roller pair is opened). When power supply to the plunger solenoid 45 is shut down, the upper roller 24*a* is abutted against the lower roller 24*b* by the urging force of a pressing spring 48 connected to the roller shaft of the upper roller 24*a*. As a result, the discharge-and-reverse roller 24 becomes an abutment state (that is, the nip portion is closed). When the upper roller 24*a* is abutted against the lower roller 24*b* by the urging force of the pressing spring 48, the separation lever 44 is rotated in an E2 direction by the movement of the upper roller 24*a*, and the plunger of the plunger solenoid 45 is moved in a D2 direction. Note that the mechanism to open and close the discharge-and-reverse roller 24 may be another mechanism. For example, the separation lever 44 may be swung by a cam that is rotated by the driving force of a motor.

The inner discharge roller 26 is a roller pair that is disposed adjacent to the discharge-and-reverse roller 24 in the sheet conveyance direction in the inner discharge path 82, and that can rotate in a forward and a reverse direction. That is, the inner discharge roller 26 can convey a sheet in both a direction (hereinafter referred to as a G1 direction) extending from the discharge-and-reverse roller 24 toward the sheet processing portion 71, and a direction (hereinafter referred to as a G2 direction) extending from the sheet processing portion 71 toward the discharge-and-reverse roller 24.

Hardware Configuration

Figure 3:
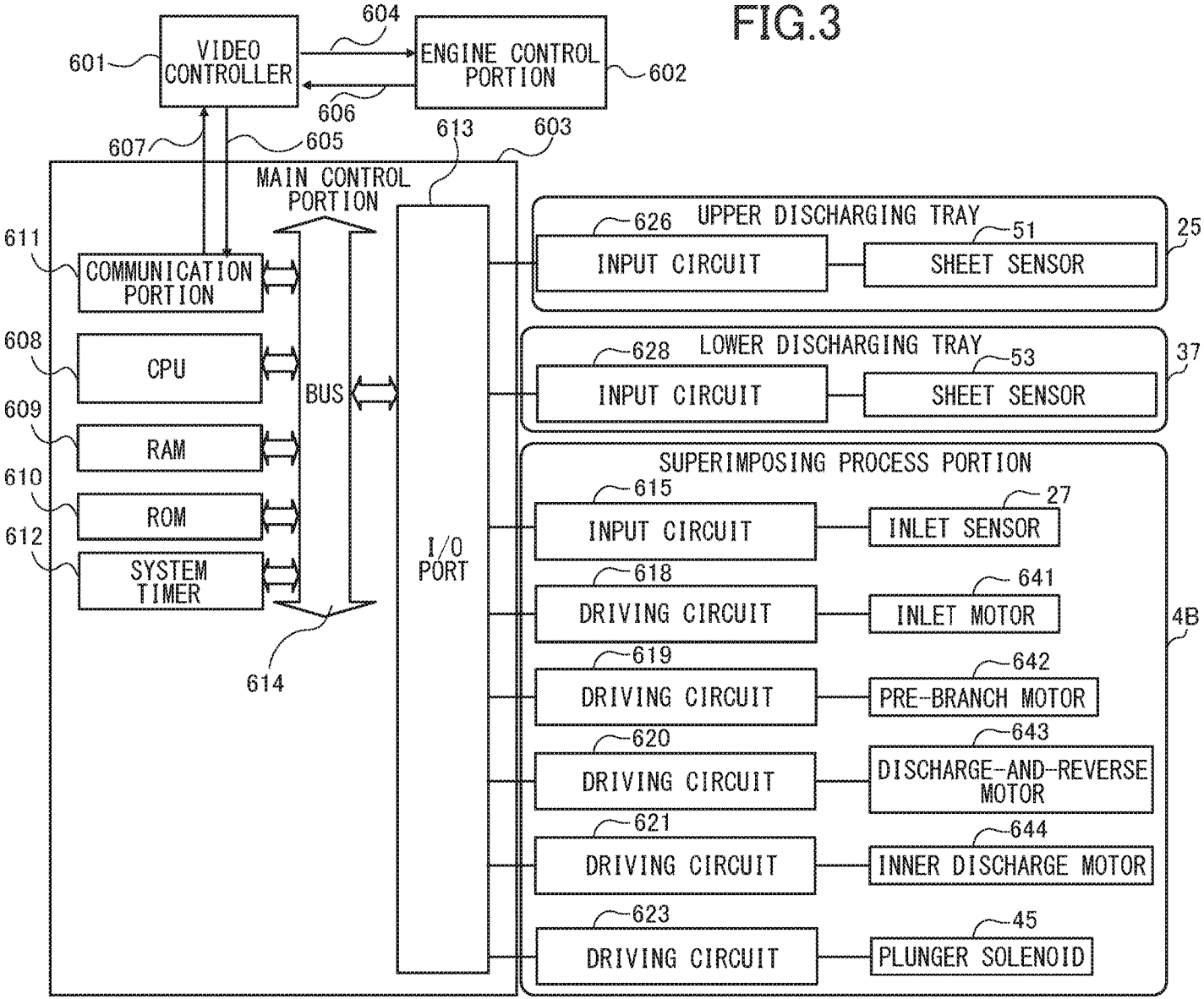
FIG. 3 is a hardware configuration diagram of the image forming system of the first embodiment.

Next, a hardware configuration of the image forming system 1S of the present embodiment will be described with reference to FIG. 3. FIG. 3 mainly illustrates a hardware configuration of the sheet processing apparatus 4 of the image forming system 1S. A video controller 601 controls the whole of the image forming system 1S that includes the image forming apparatus 1 and the sheet processing apparatus 4. An engine control portion 602 controls the image forming apparatus 1.

A main control portion 603 controls the sheet processing apparatus 4. A signal line 604 is a signal line for serial command transmission, via which the video controller 601 transmits a command to the engine control portion 602 through serial communication. A signal line 605 is a signal line for serial command transmission, via which the video controller 601 transmits a command to the main control portion 603 through serial communication. A signal line 606 is a signal line for serial status transmission, via which the engine control portion 602 transmits status data to the video controller 601 through serial communication, in response to the command. A signal line 607 is a signal line for serial status transmission, via which the main control portion 603 transmits status data to the video controller 601 through serial communication, in response to the command. For performing image forming operation, the video controller 601 controls the engine control portion 602 and the main control portion 603 by transmitting serial commands to the engine control portion 602 and the main control portion 603 and receiving status data from the engine control portion 602 and the main control portion 603. In this manner, when the image forming system 1S in which a plurality of apparatuses is connected with each other is operated, the video controller 601 controls the apparatuses and manages the conditions of the apparatuses for keeping the consistency of operations of the apparatuses.

The main control portion 603 includes a CPU 608 and a RAM 609. The CPU 608 controls various operations of the sheet processing apparatus 4, and the RAM 609 temporarily stores control data necessary for the operations of the sheet processing apparatus 4. The main control portion 603 also includes a nonvolatile ROM 610 that stores a program and a control table necessary for the operations of the sheet processing apparatus 4. The main control portion 603 also includes a communication portion 611, a system timer 612, and an I/O port 613. The communication portion 611 performs communication with the video controller 601. The system timer 612 generates timings necessary for various types of control. The I/O port 613 sends/receives control signals to/from various units of the sheet processing apparatus 4. The main control portion 603 is a control circuit in which the above-described components are connected with each other via a bus 614.

An input signal from the inlet sensor 27 is transmitted to the main control portion 603 via an input circuit 615, an input signal from the sheet sensor 51 of the upper discharging tray 25 is transmitted to the main control portion 603 via an input circuit 626, and an input signal from the sheet sensor 53 of the lower discharging tray 37 is transmitted to the main control portion 603 via an input circuit 628. In addition, a control signal from the main control portion 603 is transmitted to an inlet motor 641, a pre-branch motor 642, a discharge-and-reverse motor 643, an inner discharge motor 644, or the plunger solenoid 45 via driving circuits 618, 619, 620, 621, or 623. With this operation, each actuator is driven and controlled.

Functional Block

Figure 4:
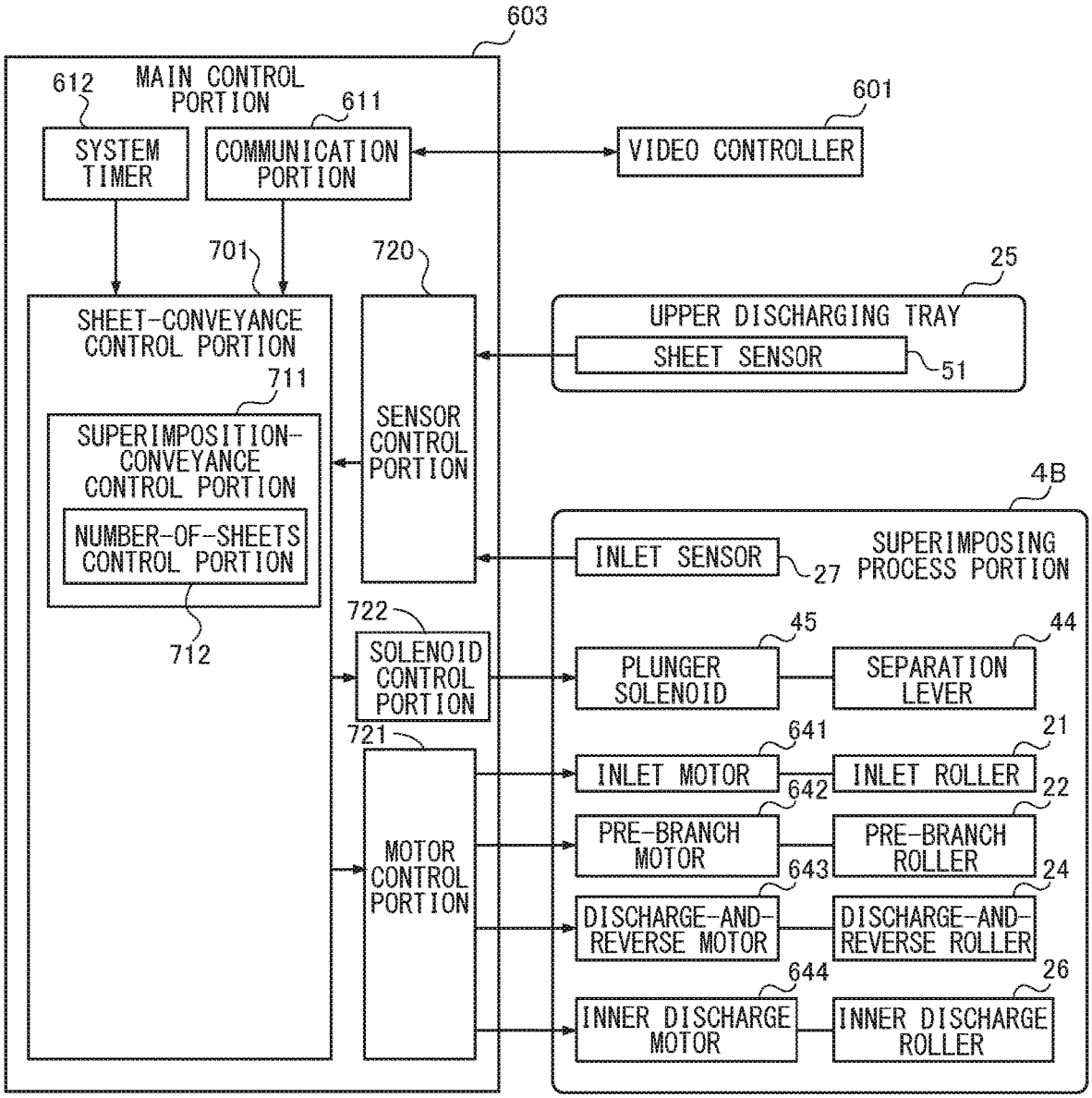
FIG. 4 is a functional block diagram of the image forming system of the first embodiment.

Next, a functional block of the present embodiment will be described with reference to FIG. 4. The main control portion 603 illustrated in FIG. 4 has a function that executes the sheet conveyance operation of the sheet processing apparatus 4. The main control portion 603 at least has functions of the communication portion 611, the system timer 612, a sheet-conveyance control portion 701, a sensor control portion 720, a motor control portion 721, and a solenoid control portion 722.

The sensor control portion 720 receives signals from the inlet sensor 27 and the sheet sensor 51 of the upper discharging tray 25, and sends the signals to the sheet-conveyance control portion 701. The sheet-conveyance control portion 701 includes a superimposition-conveyance control portion 711 and a number-of-sheets control portion 712. The sheet-conveyance control portion 701 controls the motor control portion 721 and the solenoid control portion 722 in accordance with signals sent from the sensor control portion 720, and thereby operates the superimposing process portion 4B, the upper discharging tray 25, and the lower discharging tray 37. The superimposition-conveyance control portion 711 controls the conveyance of sheets conveyed to the superimposing process portion 4B and the upper discharging tray 25. Specifically, the superimposition-conveyance control portion 711 controls the conveyance of sheets in accordance with signals sent from the sensor control portion 720, while controlling the position of the sheets.

The number-of-sheets control portion 712 manages the number of sheets superimposed in the superimposing process portion 4B when a job is performed for successively forming an image on a plurality of sheets. The number-of-sheets control portion 712 determines whether to convey the superimposed sheets toward the upper discharging tray 25 or the sheet processing portion 71 or to superimpose a following sheet on the superimposed sheets, depending on the maximum number of sheets, the number of sheets currently superimposed, and information of the sheet. The maximum number of sheets is the number of sheets that can be superimposed on each other by the superimposing process portion 4B.

Note that the inlet motor 641 drives the inlet roller 21, the pre-branch motor 642 drives the pre-branch roller 22, and the discharge-and-reverse motor 643 drives the discharge-and-reverse roller 24. In addition, the inner discharge motor 644 drives the inner discharge roller 26, and the plunger solenoid 45 drives the separation lever 44. The operation of the components driven by the above-described motors will be described in detail later.

Superimposing-Discharge Operation

With reference to FIGS. 5A to 5F, the outline of the operation (superimposing-discharge operation) in which the superimposition-conveyance control portion 711 causes the superimposing process portion 4B to superimpose a plurality of sheets and discharges the sheets will be described. Hereinafter, a sheet (first sheet) that is sent from the image forming apparatus 1 to the sheet processing apparatus 4 for the first time for the superimposing-discharge operation is referred to as a sheet S1, and a sheet (second sheet) that is sent from the image forming apparatus 1 to the sheet processing apparatus 4 for the second time for the superimposing-discharge operation is referred to as a sheet S2. In addition, the pre-acceleration conveyance speed (i.e., conveyance speed produced by the relay unit 14) produced by the pre-branch roller 22, the discharge-and-reverse roller 24, and the inner discharge roller 26 is denoted by V1, and the post-acceleration conveyance speed is denoted by V2.

In general, in the superimposing-discharge operation, the discharge-and-reverse roller 24 (second conveyance portion) reverses the conveyance direction of the sheet S1 sent from the pre-branch roller 22 (first conveyance portion), and delivers the sheet S1 to the inner discharge roller 26 (third conveyance portion) (FIGS. 5A to 5D). After that, if the inlet sensor 27 (detection portion) outputs the detection signal in response to the sheet S2 that is conveyed following the sheet S1, the inner discharge roller 26 (third conveyance portion) conveys the sheet S1 toward the discharge-and-reverse roller 24 (second conveyance portion) (FIG. 5E). Then, the discharge-and-reverse roller 24 (second conveyance portion) discharges the sheet S1 and the sheet S2 to the upper discharging tray 25 (stacking portion), with the sheet S1 and the sheet S2 superimposed on each other in a state where an edge portion of the sheet S1 in the conveyance direction is aligned with an edge portion of the sheet S2 in the conveyance direction (FIG. 5F).

Figure 5A:
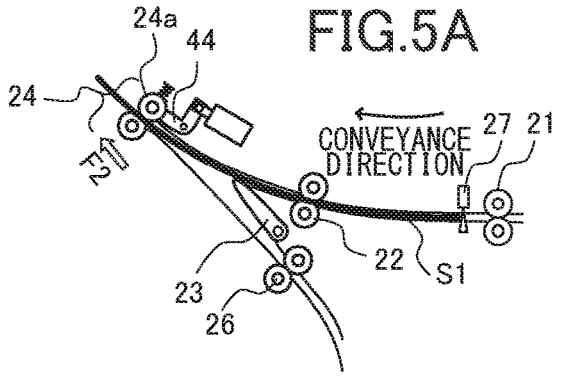
FIG. 5A is a diagram for illustrating an operation of the superimposing process portion of the first embodiment.

In FIG. 5A, at a timing at which the trailing edge of the preceding sheet S1 passes the inlet sensor 27, the speed of the pre-branch roller 22 and the discharge-and-reverse roller 24 is increased from the speed V1 to the speed V2. Since the conveyance speed of the sheet S1 is increased, a sheet distance necessary for the switch back can be secured between the sheet S1 and the following sheet S2 even if the image forming apparatus 1 is a high-performance machine with high throughput. However, if the sheet S1 and the sheet S2 do not collide with each other, the conveyance speed at the inlet sensor 27 may not be increased. In this case, the conveyance speed in the superimposing process portion 4B may always be V1. In FIG. 5A, the discharge-and-reverse roller 24 conveys the sheet S1 in an F2 direction.

Figure 5B:
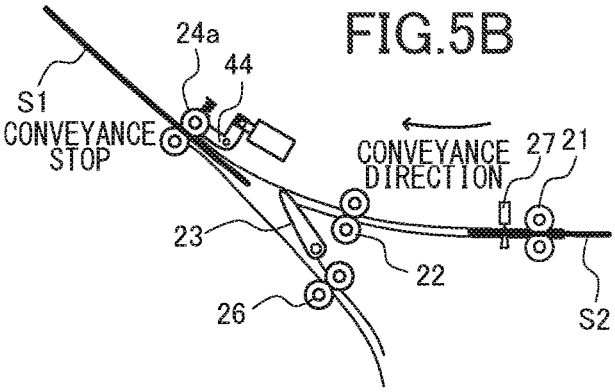
FIG. 5B is a diagram for illustrating the operation of the superimposing process portion of the first embodiment.

In FIG. 5B, at a timing at which the trailing edge of the sheet S1 has passed the non-return guide 23 after the trailing edge of the sheet S1 passed the inlet sensor 27 and moved by a predetermined distance, the conveyance of the sheet S1 is temporarily stopped. The predetermined distance is determined such that when the trailing edge of the sheet S1 has moved by the predetermined distance in the F2 direction, the trailing edge of the sheet S1 has passed the non-return guide 23 but does not reach the nip portion of the discharge-and-reverse roller 24.

Figure 5C:
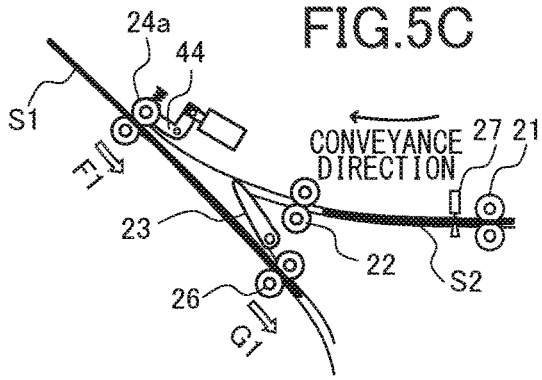
FIG. 5C is a diagram for illustrating the operation of the superimposing process portion of the first embodiment.

In FIG. 5C, the discharge-and-reverse roller 24 changes its rotational direction, and conveys the sheet S1 in an F1 direction at the speed V2. The inner discharge roller 26 is driven before the leading edge of the sheet S1 in the F1 direction reaches the inner discharge roller 26, and further conveys the sheet S1 in the G1 direction.

Figure 5D:
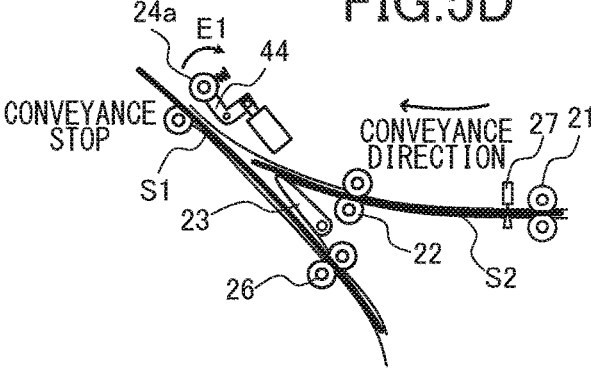
FIG. 5D is a diagram for illustrating the operation of the superimposing process portion of the first embodiment.
Figure 5E:
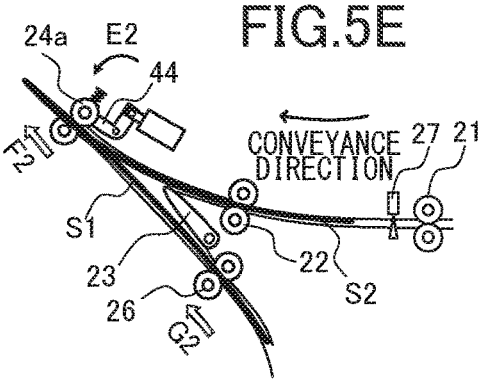
FIG. 5E is a diagram for illustrating the operation of the superimposing process portion of the first embodiment.
Figure 5F:
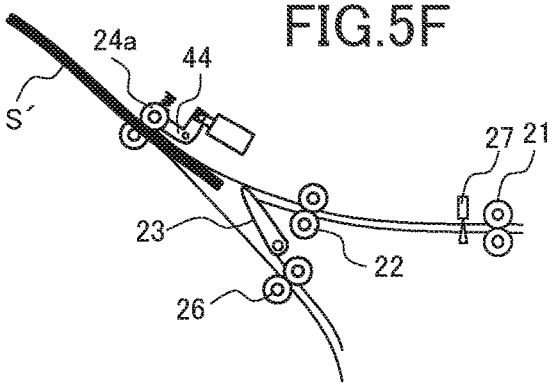
FIG. 5F is a diagram for illustrating the operation of the superimposing process portion of the first embodiment.

In FIG. 5D, at a position to which the sheet S1 has been conveyed by a predetermined amount of distance after the leading edge of the sheet S1 in the G1 direction (F1 direction) passed the inner discharge roller 26, in a state where the sheet S1 is nipped by the inner discharge roller 26, the conveyance of the sheet S1 is stopped. The predetermined amount of distance is smaller than a distance by which the leading edge of the sheet S1 can move to reach the intermediate conveyance roller 28. The upper roller 24*a* of the discharge-and-reverse roller 24 is moved in the E1 direction by the separation lever 44 at a timing at which the sheet S1 is nipped by the inner discharge roller 26, so that the upper roller 24*a* is separated from the lower roller 24*b*. Note that the discharge-and-reverse roller 24 is driven such that the upper roller 24*a* is separated from the lower roller 24*b* before the leading edge of the following sheet S2 reaches the discharge-and-reverse roller 24.

In FIG. 5E, after the trailing edge of the following sheet S2 has passed the inlet sensor 27, the speed of the pre-branch roller 22 and the discharge-and-reverse roller 24 is increased up to the speed V2, as is increased for the preceding sheet S1. At a point of time at which a predetermined time T_wait has elapsed since the trailing edge of the sheet S2 passed the inlet sensor 27, the inner discharge roller 26 starts to rotate again and conveys the sheet S1 toward the discharge-and-reverse roller 24 in the G2 direction. The predetermined time T_wait will be described later. At a timing at which the relative velocity of the sheet S1 to the sheet S2 (or the relative velocity of the sheet S2 to the sheet S1) becomes zero, the upper roller 24*a* of the discharge-and-reverse roller 24 is driven in the E2 direction and abuts against the lower roller 24*b*, so that the discharge-and-reverse roller 24 nips the sheet S1 and the sheet S2 at the same time. At this point of time, the leading edge of the sheet S1 in the F2 direction and the leading edge of the sheet S2 in the F2 direction are aligned with each other. In addition, the rotational speed of the discharge-and-reverse roller 24 is adjusted so that the rotational speed becomes equal to the conveyance speed V2 of the sheet S1 and the sheet S2 before the sheet S1 and the sheet S2 are nipped by the discharge-and-reverse roller 24.

In FIG. 5F, when the trailing edge of the sheet S2 passes the non-return guide 23, the sheet S1 and the sheet S2 become a sheet bundle S', in which the leading edge of the sheet S1 in the F2 direction and the leading edge of the sheet S2 in the F2 direction are aligned with each other and the trailing edge of the sheet S1 in the F2 direction and the trailing edge of the sheet S2 in the F2 direction are aligned with each other. If the destination to which the sheet bundle S' is discharged is set as the upper discharging tray 25, the sheet bundle S' is discharged to the upper discharging tray 25 by the discharge-and-reverse roller 24, while keeping the speed V2.

Figure 5G:
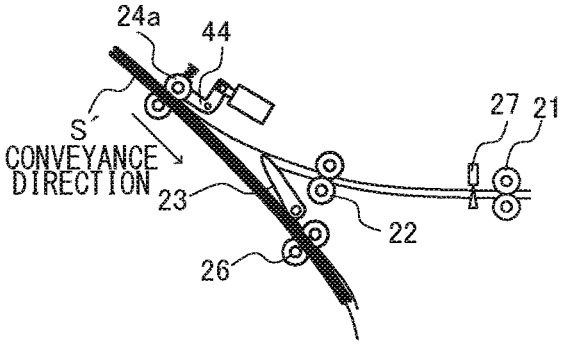
FIG. 5G is a diagram for illustrating the operation of the superimposing process portion of the first embodiment.

In FIG. 5G, if the destination to which the sheet bundle S' is discharged is set as the lower discharging tray 37, the discharge-and-reverse roller 24 temporarily stops when the trailing edge of a sheet (i.e., sheet S2 in the present embodiment) that is the last sheet added to the sheet bundle S' passes the non-return guide 23. Then the sheet bundle S' is conveyed toward the sheet processing portion 71 by the discharge-and-reverse roller 24, at the speed V2.

In this manner, the operation (superimposing-discharge operation) in which the two sheets S1 and S2 are superimposed on each other, while aligned, and discharged in the superimposing process portion 4B is completed. In a case where an image forming operation is successively performed on a plurality of sheets, sheet bundles, each having two sheets, are stacked on the upper discharging tray 25 one after another, by repeating the above-described superimposing-discharge operation.

Next, advantages of the present embodiment will be described in comparison with a case where the sheet S1 and the sheet S2 are discharged, one by one, without performing the superimposing-discharge operation. If the sheets S1 and S2 are discharged one by one, the sheets S1 and S2 that have passed through the discharge-and-reverse roller 24 fall onto the top surface of the upper discharging tray 25 or the top surface of sheets stacked on the upper discharging tray 25. However, the position and posture of the sheet S1 may change before the sheet S1 falls onto the top surface of the upper discharging tray 25, and the position and posture of the sheet S2 may change before the sheet S2 falls onto the top surface of the sheet S1. This is because the sheets S1 and S2, which receive the air resistance, fall while moving in a front-and-back direction and in a right-and-left direction when viewed from above.

In contrast, in the present embodiment, since the sheets S1 and S2 are discharged in a state where the sheets S1 and S2 are superimposed on each other while aligned in the sheet conveyance direction, the position and posture of the sheets S1 and S2 are less changed. This is because the sheet bundle, which is discharged through the superimposing-discharge operation, has a weight two times larger than a single sheet, although having the same projection area as that of the single sheet when viewed from above, and thus receives less air resistance, compared to the single sheet that is discharged one by one. Therefore, even if the sheet discharge speed produced by the discharge-and-reverse roller 24 is made faster for increasing the productivity of the image forming system 1S and the sheet processing apparatus 4, the sheet stacking performance can be suppressed from lowering. That is, in the present embodiment, the sheet stacking performance in the upper discharging tray 25 can be increased while the productivity is kept. In addition, in the present embodiment, sheets can be superimposed and discharged in the simple and compact configuration, unlike a method in which sheets are stacked, aligned, and discharged by an intermediate stacking portion, such as the sheet processing portion 71.

Note that in the present embodiment, the upper discharging tray 25 that serves as a stacking portion projects toward the outside of the apparatus body 4A. Thus, a sheet discharged to a space above the upper discharging tray 25 by the discharge-and-reverse roller 24 falls onto the upper discharging tray 25 by the gravity, without being conveyed to a conveyance portion other than the discharge-and-reverse roller 24. Even in such a configuration that is more easily subjected to the air resistance, the sheet stacking performance in the upper discharging tray 25 can be increased by performing the superimposing-discharge operation.

Superimposing-Discharge Operation for Three or More Sheets

In the above description, the sheet conveyance for two sheets has been described. However, the sheet processing apparatus 4 of the present embodiment can perform a superimposing-discharge operation in which three or more sheets are superimposed on each other while aligned, and discharged to the upper discharging tray 25 in the superimposing process portion 4B.

In a case where the superimposing-discharge operation is performed on three sheets, the two sheets S1 and S2 are first superimposed on each other by performing the procedure described above with reference to FIGS. 5A to 5F, and then the sheet bundle S' is conveyed again in the G1 direction by rotating the discharge-and-reverse roller 24 in the reverse direction. Then, while the operation that has been performed on the sheet S1 in FIGS. 5C to 5F is performed on the sheet bundle S', the operation that has been performed on the sheet S2 in FIGS. 5C to 5F is performed on the third sheet S3 (third sheet).

In these operations, at a point of time at which the predetermined time T_wait has elapsed since the trailing edge of the third sheet was detected by the inlet sensor 27 after the sheet bundle S' was temporarily stopped while held by the inner discharge roller 26 disposed on the inner discharge path 82, the sheet bundle S' is conveyed in the G2 direction by the inner discharge roller 26. After that, the discharge-and-reverse roller 24 that has been opened is closed, so that the three sheets S1, S2, and S3 are nipped by the discharge-and-reverse roller 24 at the same time. When the trailing edge of the sheet S3 passes the non-return guide 23, the sheets S1, S2, and S3 constitute a sheet bundle, in which the leading edge of the sheet S1, the leading edge of the sheet S2, and the leading edge of the sheet S3 are aligned with each other, and in which the trailing edge of the sheet S1, the trailing edge of the sheet S2, and the trailing edge of the sheet S3 are aligned with each other.

If the number of sheets on which the superimposing-discharge operation is performed is three, the sheet bundle is directly discharged in the G2 direction by the discharge-and-reverse roller 24, and stacked on the upper discharging tray 25. If the number of sheets on which the superimposing-discharge operation is performed is four or more, the number of superimposed sheets can be increased by repeating the operation in which the sheet bundle is conveyed again in the G1 direction and subjected to the operations illustrated in FIGS. 5C to 5F, by the discharge-and-reverse roller 24.

The number-of-sheets control portion 712 manages the number of sheets superimposed on each other by the superimposing process portion 4B, depending on the number of sheets that can be superimposed on each other by the superimposing process portion 4B, and on the information on the sheets that are being conveyed. That is, whether a sheet that has been sent to the superimposing process portion 4B is conveyed (discharged) directly to the upper discharging tray 25 or the sheet processing portion 71, or a following sheet is superimposed on the sheet is determined by the number-of-sheets control portion 712.

An example of the determination method will be described. If the number of sheets that can be superimposed on each other by the superimposing process portion 4B is N, the number-of-sheets control portion 712 forms a sheet bundle having an N−1 number of sheets, and discharges the sheet bundle to the upper discharging tray 25. That is, when the control portion of the present embodiment performs a job that discharges a plurality of sheets to the stacking portion, the control portion repeats the superimposing-discharge operation, as a discharge operation, so that for each predetermined number of sheets among the plurality of sheets to be discharged in the job, the predetermined number of sheets are superimposed on each other and discharged. In addition, if the control portion determines that the Nth sheet is the last sheet in the job, the control portion sets N to the number of sheets superimposed by the superimposing process portion 4B. Consequently, the Nth sheet is prevented from being discharged alone to the upper discharging tray 25.

For example, assume that the number of sheets that can be superimposed on each other by the superimposing process portion 4B is five in the configuration of the present embodiment. In this case, the number-of-sheets control portion 712 repeats the superimposing-discharge operation performed on four sheets, and stacks sheet bundles, each having four sheets, on the upper discharging tray 25 one after another. If the number-of-sheets control portion 712 determines that the fifth sheet is the last sheet, and that if the superimposing-discharge operation is performed on the four sheets, the last sheet will be discharged alone, the number-of-sheets control portion 712 performs the superimposing-discharge operation on the five sheets including the last sheet, and discharges the sheets to the upper discharging tray 25. If the number-of-sheets control portion 712 determines that even if the superimposing-discharge operation is performed on the four sheets, the last sheet will be superimposed on another sheet, the number-of-sheets control portion 712 discharges a sheet bundle including the last sheet to the upper discharging tray 25 when the sheet bundle is formed.

In other words, when the number-of-sheets control portion 712 executes a job that discharges a predetermined number of sheets to the upper discharging tray 25, the number-of-sheets control portion 712 changes the number of sheets of a sheet bundle formed through the superimposing-discharge operation, on the basis of the predetermined number of sheets. In this case, each of the predetermined number of sheets is included in a sheet bundle including two or more sheets and formed through the superimposing-discharge operation, and the sheet bundle is discharged to the upper discharging tray 25. In still other words, the control portion of the present embodiment changes the number of sheets to be superimposed on each other through the superimposing-discharge operation, on the basis of the number of sheets discharged by the job. In this case, each sheet among the plurality of sheets to be discharged during the job is discharged to the stacking portion while the sheet being superimposed on another sheet among the plurality of sheets. With this operation, since the sheet is not discharged alone to the upper discharging tray 25, the sheet stacking performance can be suppressed from lowering. Note that the method of controlling the number of sheets superimposed on each other through the superimposing-discharge operation is not limited to this as long as the sheet can be prevented from being discharged alone. For example, the number of sheets superimposed on each other through the superimposing-discharge operation may be changed such that the number changes in the order of 4, . . . , 4, 3, and 2.

Determination of T_Wait

Next, timing control (i.e., determination of the above-described T_wait) performed by the superimposition-conveyance control portion 711 for aligning the leading edges of the sheets S1 and S2 in the superimposing process portion 4B will be described.

Figure 7A:
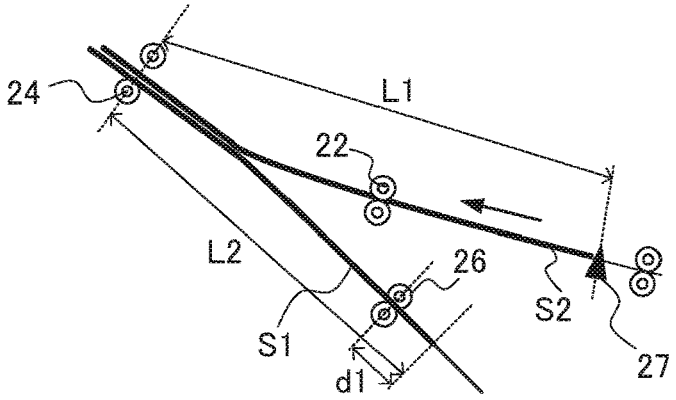
FIG. 7A is a diagram for illustrating a method in which the superimposing process portion of the first embodiment controls the amount of projection between sheets.

FIG. 7A illustrates a positional relationship between the sheet S1 and sheet S2, obtained at the moment at which the trailing edge of the sheet S2 is detected by the inlet sensor 27. A distance L1 is a distance from the detection position of the inlet sensor 27 to the nip position of the discharge-and-reverse roller 24 (the distance L1 is measured along the receiving path 81 and the first discharging path 83). A distance L2 is a distance from a position at which the leading edge of the sheet S1 whose conveyance direction has been reversed is stopped, to the nip portion of the discharge-and-reverse roller 24 (the distance L2 is measured along the first discharging path 83 and the inner discharge path 82). The leading edge of the sheet S1 is stopped at the position after the leading edge passes the inner discharge roller 26 and moves by a predetermined distance d1.

Figure 7B:
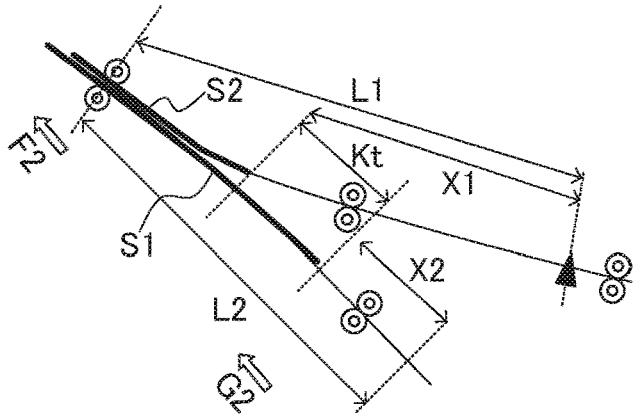
FIG. 7B is a diagram for illustrating the method in which the superimposing process portion of the first embodiment controls the amount of projection between sheets.

FIG. 7B illustrates a positional relationship between the sheet S1 and the sheet S2, obtained at a timing at which the conveyance speed of the sheet S1 and the conveyance speed of the sheet S2 become equal to each other after the sheet S1 is started to be conveyed in the F2 direction (G2 direction) in the state illustrated in FIG. 7A. Assume that at this point of time, the trailing edge of the sheet S1 in the F2 direction is shifted from the trailing edge of the sheet S2 in the F2 direction by the amount of projection Kt.

Figure 7C:
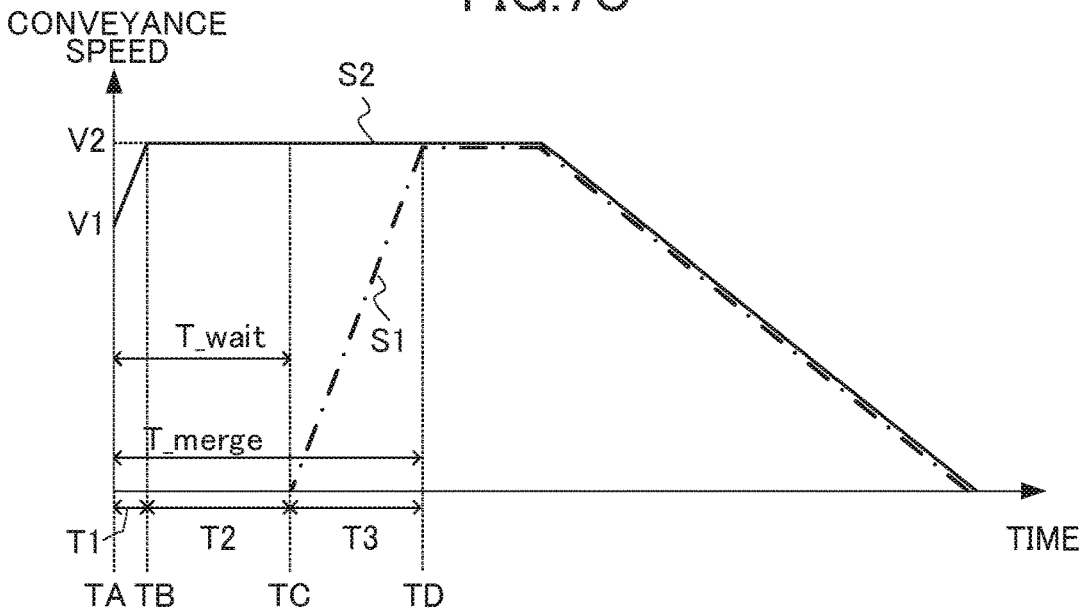
FIG. 7C is a diagram for illustrating the method in which the superimposing process portion of the first embodiment controls the amount of projection between sheets.

FIG. 7C illustrates the change in speed of the sheets S1 and S2, obtained in the operations illustrated in FIGS. 7A and 7B. In FIG. 7C, a time TA indicates a moment at which the trailing edge of the sheet S2 is detected by the inlet sensor 27 as illustrated in FIG. 7A and the uniform acceleration of the pre-branch roller 22 from the speed V1 to the speed V2 is started. A time TB indicates a timing at which the acceleration of the sheet S2 up to the speed V2 is completed. A time TC indicates a timing at which the predetermined time T_wait has elapsed since the trailing edge of the sheet S2 was detected by the inlet sensor 27, that is, a timing at which the conveyance of the sheet S1 in the G2 direction is started by the inner discharge roller 26. A time TD indicates a timing at which the relative velocity of the sheet S1 to the sheet S2 (or the relative velocity of the sheet S2 to the sheet S1) becomes zero.

Hereinafter, an elapsed time from TA to TD is denoted by T_merge. A time T1 is a time (i.e., elapsed time from TA to TB) necessary to increase the speed of the pre-branch roller 22 from the speed V1 to the speed V2. A time T2 is a time (i.e., elapsed time from TB to TC) from when the acceleration of the pre-branch roller 22 up to the speed V2 is completed until when the rotation of the inner discharge roller 26 is started. Since T1, T2, and T_wait are defined as described above, the time T_wait is expressed as: T_wait=T1+T2. A time T3 is a time (i.e., elapsed time from TC to TD) from when the uniform acceleration of the sheet S1 is started in a stop state of the sheet S1, until when the speed of the sheet S1 reaches the speed V2.

As can be seen from the above description, a distance X2 by which the sheet S1 moves from the position illustrated in FIG. 7A to the position illustrated in FIG. 7B is equal to a distance by which the sheet S1 moves from TC to TD in FIG. 7C. Thus, the distance X2 is expressed by the following equation (1).

$$X2=(V2\times T3)/2 \tag{1}$$

In addition, a distance X1 by which the sheet S2 moves from the position illustrated in FIG. 7A to the position illustrated in FIG. 7B is equal to a distance by which the sheet S2 moves from TA to TD in FIG. 7C. Thus, the distance X1 is expressed by the following equation (2).

$$X1=(V1+V2)\times T1/2+V2\times(T2+T3) \tag{2}$$

From the positional relationship between the sheet S1 and the sheet S2 at a timing illustrated in FIG. 7B, the following equation (3) is satisfied.

$$L1-X1=L2-X2-Kt \tag{3}$$

If the equation (1) and the equation (2) are substituted into the equation (3), and the equation (3) is simplified, the following equation (4) is obtained.

$$L1-L2+Kt=(T1/2)\times V1+(T1/2+T2+T3/2)\times V2 \tag{4}$$

If the equation T_wait=T1+T2 is substituted into the equation (4) and the equation (4) is simplified, the following equation (5) is obtained. The equation (5) expresses the wait time T_wait obtained when the amount of projection Kt is provided, and the wait time T_wait is a time from when the trailing edge of the sheet S2 passes the inlet sensor 27, until when the conveyance of the sheet S1 is started by the inner discharge roller 26.

$$T_\text{wait}=(L1-L2+Kt)/V2-(T1/2)\times(V1/V2)+(T1-T3)/2 \tag{5}$$

For superimposing the sheets S1 and S2 on each other such that the leading edge of the sheet S1 and the leading edge of the sheet S2 are aligned with each other, and that the trailing edge of the sheet S1 and the trailing edge of the sheet S2 are aligned with each other, the wait time T_wait is calculated from the equation (5) under the condition of Kt=0. If the conveyance of the sheet S1 is started by the inner discharge roller 26 at a timing based on the calculated wait time T_wait, the sheet bundle S' can be formed such that the leading edge of the sheet S1 and the leading edge of the sheet S2 are aligned with each other, and that the trailing edge of the sheet S1 and the trailing edge of the sheet S2 are aligned with each other. That is, the predetermined time (T_wait), which is a time from when the sheet S2 is detected by the inlet sensor 27 until when the conveyance of the sheet S1 is started by the inner discharge roller 26, is preset so that the edge portion of the sheet S1 in the conveyance direction and the edge portion of the sheet S2 in the conveyance direction are aligned with each other at the discharge-and-reverse roller 24. In addition, also in a case where three or more sheets are superimposed on each other, the same value T_wait can be used for forming a sheet bundle in which the leading edge of one sheet and the leading edge of another sheet are aligned with each other and the trailing edge of one sheet and the trailing edge of another sheet are aligned with each other.

Example of Control

Figure 6:
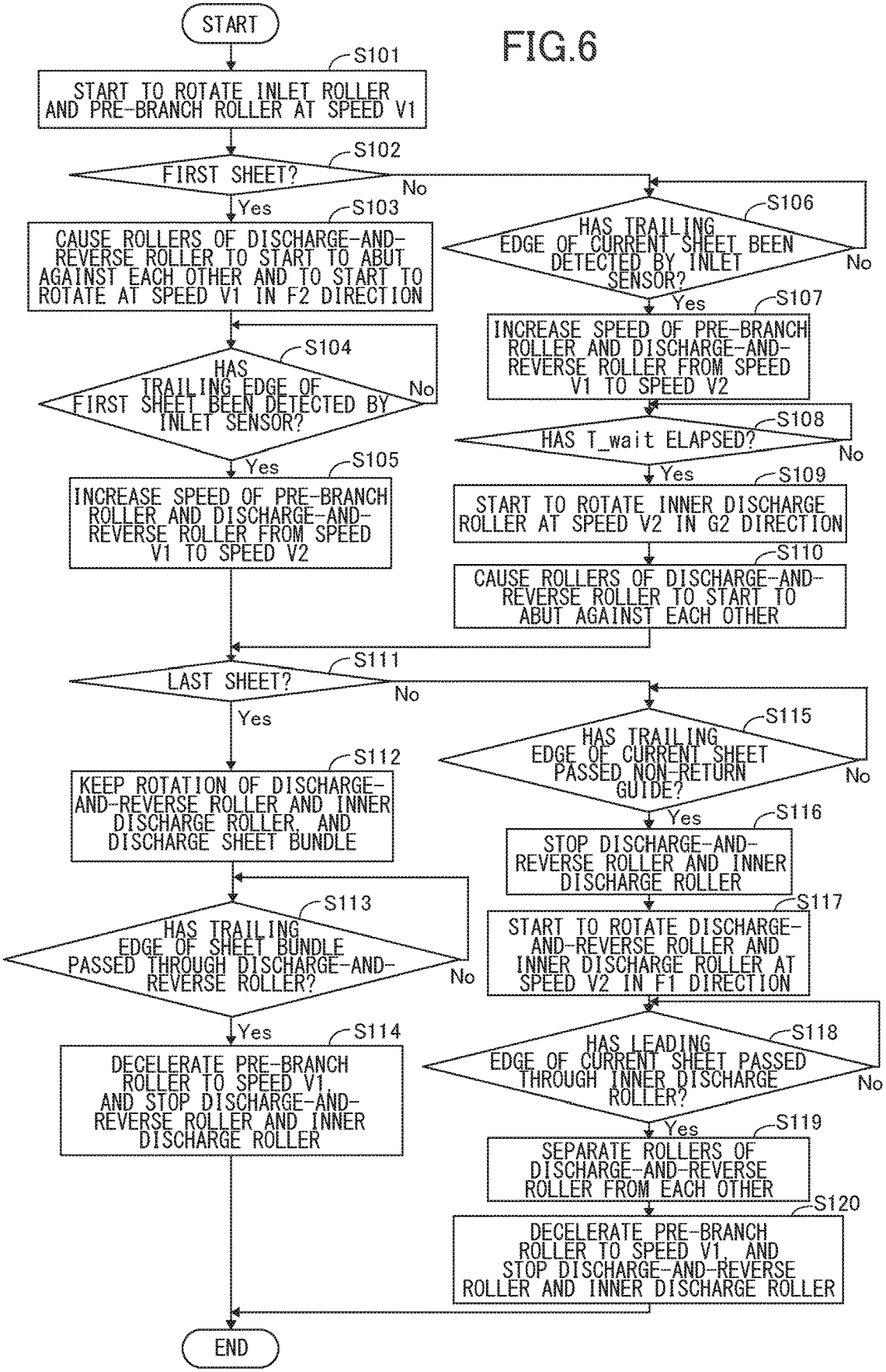
FIG. 6 is a flowchart illustrating an example of control of the superimposing process portion of the first embodiment.

Next, an example of a method of controlling the sheet processing apparatus 4 that achieves the superimposing-discharge operation described with reference to FIGS. 5A to 5F will be described with reference to the flowchart of FIG. 6. The processes of the flowchart are executed every time the main control portion 603 of the sheet processing apparatus 4 receives a notification, from the video controller 601, notifying that a single sheet is to be discharged from the image forming apparatus 1. Note that each process of the flowchart is executed by the superimposition-conveyance control portion 711 illustrated in FIG. 4, unless otherwise specified.

In the following description, the first sheet is a sheet that is conveyed to the sheet processing apparatus 4 for the first time for forming a sheet bundle to be superimposed in the superimposing process portion 4B. For example, in a case where four sheets are superimposed on each other and discharged to the upper discharging tray 25, the first sheet is a sheet, i.e., the (4n+1)th sheet, conveyed to the sheet processing apparatus 4 after the last sheet of the previous sheet bundle. In addition, the last sheet is a sheet that is conveyed to the sheet processing apparatus 4 for the last time for forming a sheet bundle formed in the superimposing process portion 4B (in the above-described example, the last sheet is the 4n-th sheet).

In Step S101, the superimposition-conveyance control portion 711 starts the rotation of the inlet roller 21 and the pre-branch roller 22 at the speed V1. Then the superimposition-conveyance control portion 711 proceeds to Step S102. Note that if the inlet roller 21 and the pre-branch roller 22 have already been rotating at the speed V1 in Step S101, the superimposition-conveyance control portion 711 keeps the rotation of the inlet roller 21 and the pre-branch roller 22. In Step S102, the superimposition-conveyance control portion 711 determines whether a current sheet is the first sheet. If the determination is Yes, then the superimposition-conveyance control portion 711 proceeds to Step S103. If the determination is No, then the superimposition-conveyance control portion 711 proceeds to Step S106.

In Step S103, the superimposition-conveyance control portion 711 causes the rollers of the discharge-and-reverse roller 24 to abut against each other and to start to rotate at the speed V1 in a direction (G2 direction) in which the first sheet is conveyed toward the upper discharging tray 25. Then the superimposition-conveyance control portion 711 proceeds to Step S104. In Step S104, the superimposition-conveyance control portion 711 determines whether the trailing edge of the first sheet has passed the inlet sensor 27. If the determination is Yes, then the superimposition-conveyance control portion 711 proceeds to Step S105. If the determination is No, then the superimposition-conveyance control portion 711 proceeds to Step S104. In Step S105, the superimposition-conveyance control portion 711 accelerates the pre-branch roller 22 and the discharge-and-reverse roller 24 up to the speed V2 (see the sheet S1 illustrated in FIG. 5A). Then the superimposition-conveyance control portion 711 proceeds to Step S111.

In Step S106, the superimposition-conveyance control portion 711 determines whether the trailing edge of a current sheet (i.e., the second sheet or another sheet following the second sheet) has passed the inlet sensor 27. If the determination is Yes, then the superimposition-conveyance control portion 711 proceeds to Step S107. If the determination is No, then the superimposition-conveyance control portion 711 proceeds to Step S106. In Step S107, the superimposition-conveyance control portion 711 accelerates the pre-branch roller 22 and the discharge-and-reverse roller 24 up to the speed V2. With this operation, the conveyance speed of the current sheet is increased from the speed V1 to the speed V2 (see the sheet S2 illustrated in FIG. 5D). Then the superimposition-conveyance control portion 711 proceeds to Step S108. In Step S108, the superimposition-conveyance control portion 711 determines whether the predetermined time T_wait has elapsed since the trailing edge of the current sheet passed the inlet sensor 27. If the determination is Yes, then the superimposition-conveyance control portion 711 proceeds to Step S109. If the determination is No, then the superimposition-conveyance control portion 711 proceeds to Step S108.

In Step S109, the superimposition-conveyance control portion 711 causes the inner discharge roller 26 to start to rotate again at the speed V2 in the direction (F2 direction) in which the first sheet is conveyed toward the discharge-and-reverse roller 24 (see the sheet S1 illustrated in FIG. 5D). Then the superimposition-conveyance control portion 711 proceeds to Step S110. In Step S110, at a timing at which the conveyance speed of the sheet (bundle) that is being conveyed by the inner discharge roller 26 and the conveyance speed of the current sheet become equal to each other, the superimposition-conveyance control portion 711 causes the upper roller 24*a* of the discharge-and-reverse roller 24 to abut against the lower roller 24*b*, by moving the upper roller 24*a* in the E2 direction (see FIG. 5E). With this operation, the sheet (bundle) that is being conveyed by the inner discharge roller 26 and the current sheet are nipped by the discharge-and-reverse roller 24 at the same time (see FIG. 5E). Then the superimposition-conveyance control portion 711 proceeds to Step S111.

In Step S111, the superimposition-conveyance control portion 711 determines whether the current sheet is the last sheet. If the determination is Yes, then the superimposition-conveyance control portion 711 proceeds to Step S112. If the determination is No, then the superimposition-conveyance control portion 711 proceeds to Step S115.

In Step S112, the superimposition-conveyance control portion 711 causes the sheet bundle including the last sheet to be discharged, to the upper discharging tray 25 (see FIG. 5F). That is, the superimposition-conveyance control portion 711 keeps the conveyance of the sheets, performed by the discharge-and-reverse roller 24 and the inner discharge roller 26 and started in S107 and S109, so that the sheet bundle is discharged to the upper discharging tray 25. The sheet bundle includes the current sheet and has a predetermined number of sheets. In addition, in the sheet bundle, the leading edge of one sheet is aligned with the leading edge of another sheet, and the trailing edge of one sheet is aligned with the trailing edge of another sheet.

In Step S113, the superimposition-conveyance control portion 711 determines whether the trailing edge of the sheet bundle has passed through the discharge-and-reverse roller 24. If the determination is Yes, then the superimposition-conveyance control portion 711 proceeds to Step S114. If the determination is No, then the superimposition-conveyance control portion 711 proceeds to Step S113. In Step S114, the superimposition-conveyance control portion 711 decelerates the pre-branch roller 22 down to the speed V1, stops the discharge-and-reverse roller 24 and the inner discharge roller 26, and ends the process. Note that if the current sheet is the last sheet in the job (that is, if no more sheet is to be sent from the image forming apparatus 1), the superimposition-conveyance control portion 711 also stops the inlet roller 21 and the pre-branch roller 22 in Step S114.

In Step S115, the superimposition-conveyance control portion 711 determines whether the trailing edge of the current sheet (that is, a sheet other than the last sheet) has passed the non-return guide 23. If the determination is Yes, then the superimposition-conveyance control portion 711 proceeds to Step S116. If the determination is No, then the superimposition-conveyance control portion 711 proceeds to Step S115. In Step S116, the superimposition-conveyance control portion 711 temporarily stops the discharge-and-reverse roller 24 and the inner discharge roller 26 (see the sheet S1 illustrated in FIG. 5B). Then the superimposition-conveyance control portion 711 proceeds to Step S117. In Step S117, the superimposition-conveyance control portion 711 causes the discharge-and-reverse roller 24 and the inner discharge roller 26 to start to rotate at the speed V2 in a rotational direction so that the sheet (bundle) is conveyed in the reverse direction (F1 direction, G1 direction). Then the superimposition-conveyance control portion 711 proceeds to Step S118.

In Step S118, the superimposition-conveyance control portion 711 determines whether the leading edge of the sheet (bundle) has passed through the inner discharge roller 26. If the determination is Yes, then the superimposition-conveyance control portion 711 proceeds to Step S119. If the determination is No, then the superimposition-conveyance control portion 711 proceeds to Step S118. In Step S119, the superimposition-conveyance control portion 711 separates the upper roller 24*a* of the discharge-and-reverse roller 24 from the lower roller 24*b*. Then the superimposition-conveyance control portion 711 proceeds to Step S120. In Step S120, at a position to which the leading edge of the sheet (bundle) has been conveyed by the predetermined amount of distance after passing through the inner discharge roller 26, the superimposition-conveyance control portion 711 decelerates the pre-branch roller 22 down to the speed V1, stops the discharge-and-reverse roller 24 and the inner discharge roller 26, and ends the process.

With these operations, the sheet (bundle) on which the superimposing-discharge operation has been performed, and on which another sheet is to be superimposed is nipped and held by the inner discharge roller 26 (see the sheet S1 illustrated in FIG. 5D). Note that the timings of the steps including S109, S113, S115, and S118 can be determined depending on a timing signal sent from the system timer 612 (FIG. 6). For example, the timings are determined depending on the operation history of the discharge-and-reverse roller 24 and the inner discharge roller 26, obtained in a period of time from when the trailing edge of the sheet S1 was detected by the inlet sensor 27.

As described above, in the present embodiment, in a case where a plurality of sheets that is successively conveyed is discharged to the stacking portion, the plurality of sheets is superimposed on each other in the superimposing process portion 4B in a state where the edge portion of one sheet is aligned with the edge portion of another sheet, and is then discharged to the stacking portion. Thus, the sheet stacking performance in the stacking portion can be increased while the productivity is kept. In addition, discharging the superimposed sheets to the upper discharging tray 25 does not need an intermediate tray including the sheet alignment function and disposed in the sheet processing apparatus. Thus, the upsizing of the apparatus, and the increase in costs caused by the upsizing can be prevented.

Note that although the maximum number of sheets (i.e., the number of sheets that can be superimposed on each other by the superimposing process portion 4B) is five in the example of a configuration of the present embodiment, the number of sheets that can be superimposed on each other by the superimposing process portion 4B can be changed as appropriate in accordance with a specific configuration and desired performance of the superimposing process portion 4B.

Buffering Operation Performed when Process is Performed in Sheet Processing Portion The superimposing process portion 4B of the present embodiment serves also as a buffer portion when the sheet processing portion 71 performs a process on sheets. That is, if the superimposing process portion 4B receives a sheet from the image forming apparatus 1 while the sheet processing portion 71 performs a process on sheets, the superimposing process portion 4B superimposes the sheet on another sheet and holds these sheets. By performing the buffering operation, the collision of sheets in the sheet processing portion 71 can be prevented without lowering the productivity of the image forming apparatus 1. Consequently, the productivity of the image forming system 1S increases.

In the buffering operation, the operation of the superimposing process portion 4B is basically the same as the superimposing-discharge operation, except that the superimposing process portion 4B conveys a bundle of superimposed sheets to the sheet processing portion 71 through the inner discharge path 82. That is, the bundle of sheets superimposed as illustrated in FIG. 5F through the operations illustrated in FIGS. 5A to 5F is conveyed not to the upper discharging tray 25, but to the sheet processing portion 71 through the inner discharge roller 26. After the sheet bundle is conveyed to the sheet processing portion 71 in the buffering operation, following sheets that do not need the buffering operation are switch-backed, one by one, by the discharge-and-reverse roller 24, and conveyed to the sheet processing portion 71.

Note that in the buffering operation, the amount of projection Kt (FIG. 7B) may be set such that the leading edge of one superimposed sheet is shifted from the leading edge of another superimposed sheet. In this case, the amount of projection Kt is preferably set such that a lower sheet (i.e., the sheet S1 illustrated in FIG. 7B), which is stacked lower in the sheet processing portion 71, projects in the sheet conveyance direction extending toward the sheet processing portion 71. If the amount of projection Kt is set as described above, the alignment operation can be effectively performed by bringing the semicircular roller 33 into contact with each sheet of the sheet bundle, which is formed through the buffering operation. In particular, it is preferable that the amount of projection Kt is larger than the distance between the contact position between the semicircular roller 33 and the sheet and the vertical-alignment reference plate 39.

As described above, the superimposing process portion 4B of the present embodiment has the function to perform the superimposing-discharge operation when sheets are discharged to the outside of the sheet processing apparatus 4 without being processed in the sheet processing portion 71, and the function to buffer the sheets to be processed in the sheet processing portion 71. Thus, the configuration of the present embodiment can downsize the apparatus and reduce costs of the apparatus, compared to the configuration in which two mechanisms to superimpose sheets are disposed for achieving the above-described functions.

Second Embodiment

In the above-described first embodiment, the description has been made for the method of increasing the stacking performance by performing the superimposing-discharge operation that superimposes and discharges sheets. In a second embodiment, a wait position of one sheet on which another sheet to be superimposed is changed in accordance with the length of the one sheet in the conveyance direction, in the superimposing-discharge operation described in the first embodiment. Hereinafter, a component given a symbol identical to a symbol of the first embodiment is regarded as a component having the same structure and effect as those of the first embodiment, and the description thereof will be omitted.

In the bundle discharge operation described in the first embodiment, the conveyance direction of the preceding sheet S1 is reversed and the sheet S1 is stopped at a position (FIG. 5D), through the operations illustrated in FIGS. 5A to 5D. Hereinafter, the description will be made for the determination of the position at which the sheet S1 is stopped. In the following description, the length of the sheet S1 in the conveyance direction is denoted by Ls. In addition, the length from the nip position of the discharge-and-reverse roller 24 to an edge portion S1*a* of the sheet S1 on the G1 direction side (i.e., on the inner discharge roller 26 side) is denoted by L2. In addition, the length from the nip position of the discharge-and-reverse roller 24 to an edge portion S1*b* of the sheet S1 that projects toward the outside of the sheet processing apparatus 4 is denoted by L3. Thus, the lengths Ls, L2, and L3 satisfy the relationship: Ls=L2+L3.

Figure 8B:
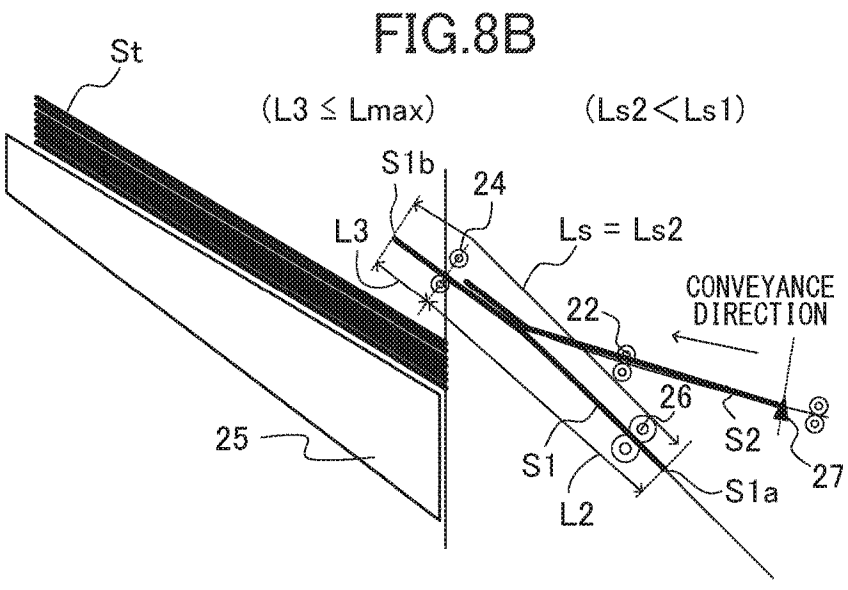
FIG. 8B is a diagram for illustrating the method in which the superimposing process portion of the second embodiment controls the amount of projection between sheets.
Figure 8A:
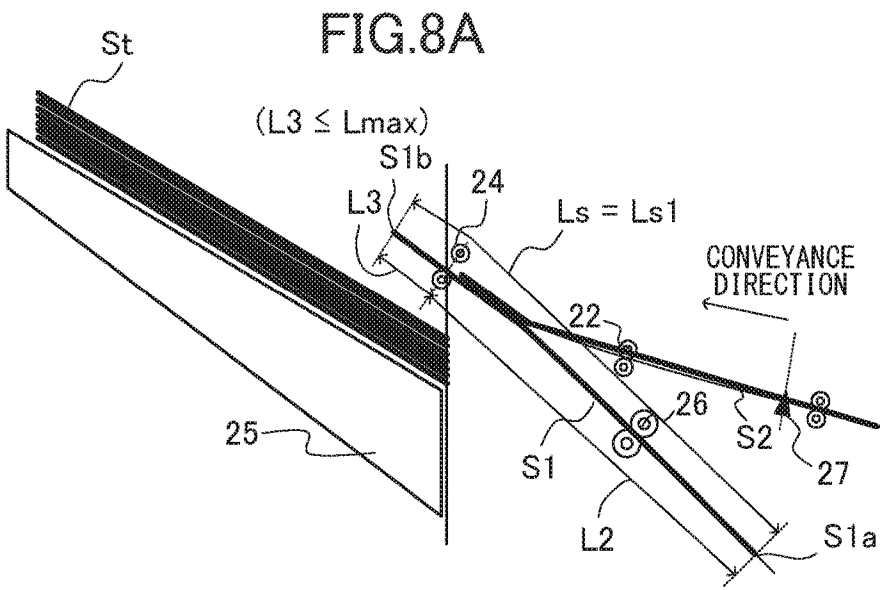
FIG. 8A is a diagram for illustrating a method in which a superimposing process portion of a second embodiment controls the amount of projection between sheets.

As illustrated in FIGS. 8A and 8B, the length Ls of a sheet (for example, an A4 sheet whose long side is parallel to the conveyance direction) that is longer in the conveyance direction is denoted By Ls1, and the length Ls of a sheet (for example, an A5 sheet whose long side is parallel to the conveyance direction) that is shorter in the conveyance direction is denoted by Ls2. The length Ls1 is an example of a first length, and the length Ls2 is an example of a second length.

Figure 8D:
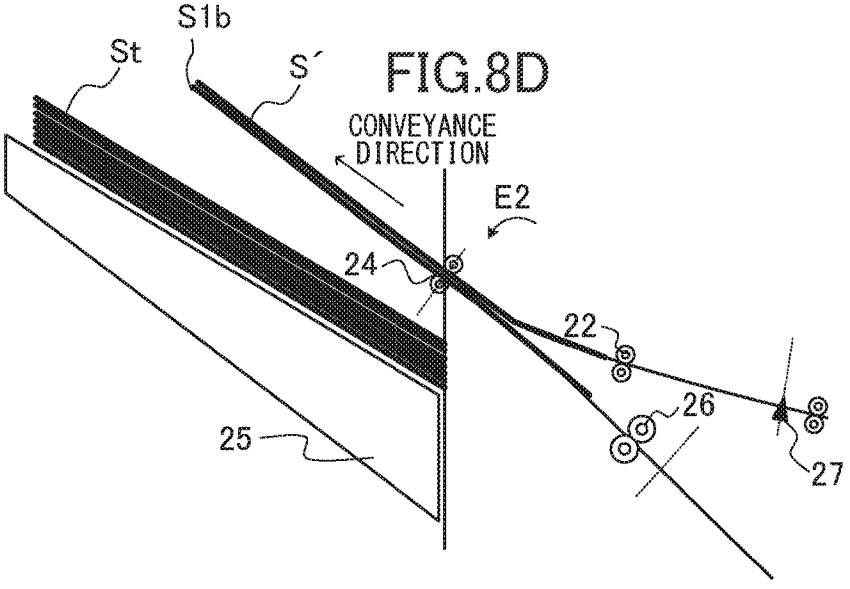
FIG. 8D is a diagram for illustrating the method in which the superimposing process portion of the second embodiment controls the amount of projection between sheets.
Figure 8C:
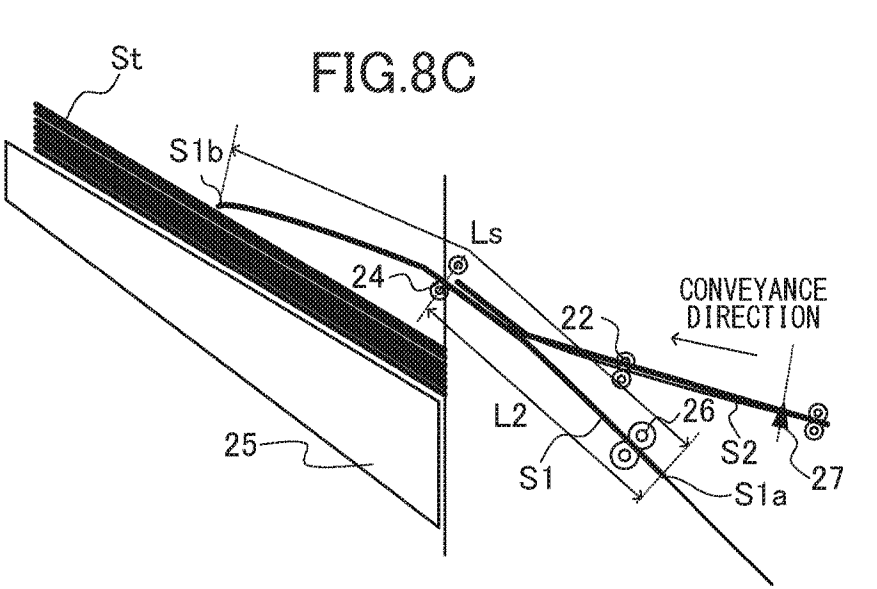
FIG. 8C is a diagram for illustrating the method in which the superimposing process portion of the second embodiment controls the amount of projection between sheets.

In the present embodiment, regardless of whether the length Ls of the sheet S1 is Ls1 or Ls2, the length L3 by which the edge portion S1*b* of the sheet S1 projects from the discharge-and-reverse roller 24 is equal to or smaller than a predetermined value Lmax. Note that the predetermined value Lmax is determined in advance to prevent the edge portion S1*b* of the sheet S1 (or a sheet bundle), which projects from the nip position of the discharge-and-reverse roller 24 by the predetermined value Lmax, from leaning against the upper discharging tray 25 as illustrated in FIG. 8C. This is because if the edge portion S1*b* of the sheet S1 that is temporarily stopped leans against a sheet St stacked on the upper discharging tray 25, the sheet S1 will rub against the sheet St when discharged later, so that the position of the stacked sheet St may be changed.

Note that the discharge-and-reverse roller 24 is designed such that when the discharge-and-reverse roller 24 nips a sheet, the cross-sectional shape of the sheet, viewed from the downstream side in the sheet discharging direction, is slightly curved (or waved) in the sheet width direction. For example, the discharge-and-reverse roller 24 may be a so-called comb-teeth roller. In this case, portions (roller bodies on a roller shaft) of the upper roller 24*a* that contact the sheet and portions (roller bodies on a roller shaft) of the lower roller 24*b* that contact the sheet are arranged alternately in the sheet width direction. In addition, the outer circumferential surfaces of the roller bodies of the upper roller 24*a* and the outer circumferential surfaces of the roller bodies of the lower roller 24*b* are disposed so as to overlap with each other when viewed in the sheet width direction.

As described above, the discharge-and-reverse roller 24 conveys a sheet while causing the sheet to have a curved shape. As a result, as illustrated in FIG. 8D, the sheet bundle S' in which sheets are superimposed on each other through the superimposing-discharge operation is discharged, with the sheet bundle S' keeping its straight posture, and with the edge portion S1*b* not bending down. Consequently, the possibility that the sheet bundle S' rubs against the sheet St stacked on the upper discharging tray 25 and deteriorates the stacking performance for the sheet St can be lowered.

Figure 9:
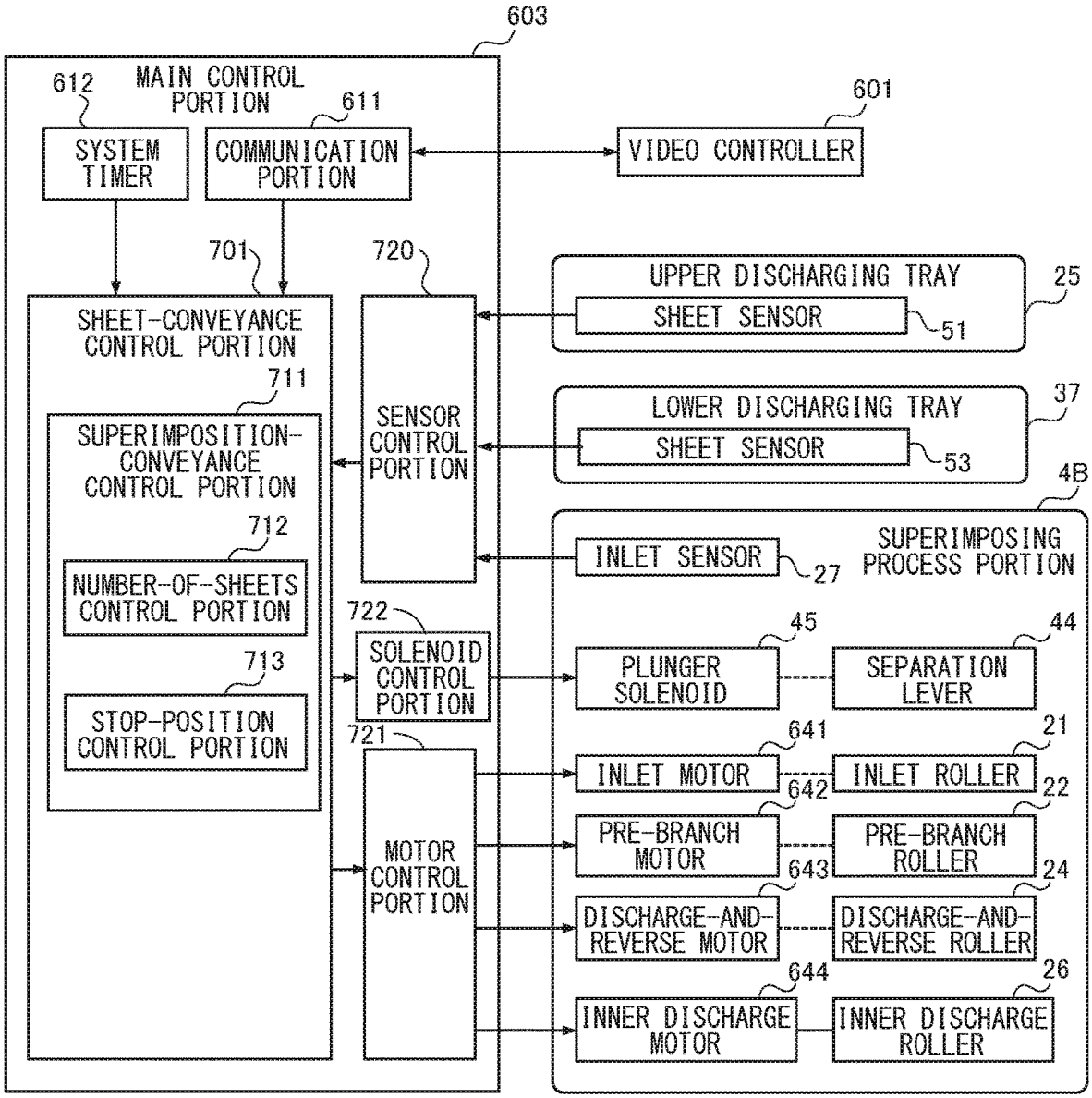
FIG. 9 is a functional block diagram of an image forming system of the second embodiment.

FIG. 9 illustrates a functional block diagram of the image forming system 1S of the present embodiment. The functional block diagram of the present embodiment differs from the functional block diagram of the first embodiment illustrated in FIG. 4 in that the superimposition-conveyance control portion 711 includes a stop-position control portion 713 in addition to the number-of-sheets control portion 712. The stop-position control portion 713 controls the position (stop position) at which a preceding sheet is temporarily stopped, when a plurality of sheets is superimposed on each other in the superimposing process portion 4B.

The stop-position control portion 713 determines the length L2 from the following equation (6). The length Ls of the sheet in the conveyance direction is obtained from the video controller 601 via the communication portion 611.

$$L2=Ls-L\max \tag{6}$$

The method of controlling the sheet processing apparatus 4 is basically the same as the method of the first embodiment described with reference to FIG. 6. In the above-described first embodiment, in Step S120, the discharge-and-reverse roller 24 and the inner discharge roller 26 are stopped when the leading edge of the sheet S1 has been conveyed by the predetermined amount of distance (i.e., the predetermined distance d1 in FIG. 7B) after the leading edge of the sheet S1 passed through the inner discharge roller 26. In the present embodiment, however, the discharge-and-reverse roller 24 and the inner discharge roller 26 are stopped at a point of time at which the sheet S1 has been conveyed by a distance d2 after the leading edge of the sheet S1 passed through the inner discharge roller 26. The distance d2 corresponds to the length L2, which is determined from the equation (6), and is calculated from an equation: d2=L2−d4, where d4 is a distance from the nip position of the discharge-and-reverse roller 24 to the inner discharge roller 26. Thus, the distance d2 is a variable that varies in accordance with the length Ls of the sheet. Note that the timing at which the leading edge of the sheet S1 has been conveyed by the distance d2 after passing through the inner discharge roller 26 can be determined depending on a timing signal sent from the system timer 612 (FIG. 6). For example, the timing is determined depending on the operation history of the discharge-and-reverse roller 24 and the inner discharge roller 26, obtained in a period of time from when the trailing edge of the sheet S1 was detected by the inlet sensor 27. The other timing control (e.g., the determination of the above-described wait time T_wait) performed by the superimposition-conveyance control portion 711 is the same as that of the first embodiment.

By using the above-described method, the wait position at which the sheet S1 is temporarily stopped is changed in accordance with the length Ls of the sheet. As a result, the projection length L3 of the sheet S1 obtained at a point of time at which the sheet S1 is temporarily stopped can be set equal to or smaller than the predetermined value Lmax. In this method, in a process in which the sheet S1 and the sheet S2 are superimposed on each other in the superimposing process portion 4B, the edge portion S1*b* of the sheet S1 that is temporarily stopped for waiting for the following sheet S2 can be prevented from bending down and rubbing against the sheet St having already been stacked on the upper discharging tray 25. As a result, the possibility that the sheet S1 moves dragging the stacked sheet St when the sheets S1 and S2 are discharged, and changes the position of the sheet St can be reduced. Consequently, the stacking performance for discharged sheets can be increased for a variety of sizes of sheets. In addition, even if the sheet S1 is curled (that is, the sheet S1 has a curved shape), the sheet S1 that is temporarily stopped hardly curls significantly in the outside of the discharge-and-reverse roller 24. Thus, when the sheets S1 and S2 are discharged, the possibility that the edge portion S1*b* becomes rounded can be reduced.

Note that there is a case in which the range of the length L2 is limited depending on a configuration of the apparatus. For example, the lower limit of the length L2 is set so that the conveyance of the sheet S1 is temporarily stopped after the edge portion S1*a* of the sheet S1 is nipped by the inner discharge roller 26. In this case, the lower limit of the length L2 may be a value obtained by adding the distance from the nip position of the discharge-and-reverse roller 24 to the nip position of the inner discharge roller 26, with a margin that is determined for causing the inner discharge roller 26 to more reliably nip the edge portion Sla.

In addition, if the conveyance of the sheet S1 is temporarily stopped after the edge portion Sla of the sheet S1 reaches the intermediate conveyance roller 28 (FIG. 1) after passing through the inner discharge roller 26, not only the inner discharge roller 26 but also the intermediate conveyance roller 28 has to be driven, with the conveyance direction reversed, in synchronization with the inner discharge roller 26 for superimposing the sheets S1 and S2 on each other. Thus, the upper limit of the length L2 is set for achieving a simple configuration in which the intermediate conveyance roller 28 is driven in only one direction. In this case, the upper limit of the length L2 may be a value obtained by subtracting a margin from the distance from the nip position of the discharge-and-reverse roller 24 to the nip position of the intermediate conveyance roller 28. The margin is determined for more reliably preventing the edge portion S1*a* from contacting the intermediate conveyance roller 28.

As described above, in the present embodiment, the wait position is changed in accordance with the length of a sheet in the conveyance direction. In this case, the wait position may be changed only when the sheet is to be discharged to the upper discharging tray 25. This is because if the sheet is to be discharged to the lower discharging tray 37, the sheet bundle S' is eventually discharged in a direction extending from the superimposing process portion 4B toward the sheet processing portion 71. In this case, the sheet bundle S' hardly interferes with the sheets stacked on the upper discharging tray 25. Thus, if a sheet is to be discharged to the lower discharging tray 37, the distance by which the sheet is conveyed, before stopped and after the conveyance direction was reversed and the leading edge of the sheet passed through the inner discharge roller 26, may be set independently of the length of the sheet in the conveyance direction.

Modifications

In the above-described first and the second embodiments, the inner discharge path 82 that serves as a second conveyance path communicates with the sheet processing portion 71. However, the second conveyance path may communicate with a destination other than the sheet processing portion 71, to which a sheet is discharged. For example, the sheet processing portion 71 may not be disposed, and a sheet that is conveyed through the inner discharge path 82 may be discharged to the lower discharging tray 37, without being processed. In addition, the second conveyance path may have a closed-end configuration in which the second conveyance path does not communicate with the outside of the sheet processing apparatus 4.

In addition, in the above-described first and second embodiments, the description has been made for the sheet discharging apparatus of the sheet processing apparatus 4, which is disposed separately from the image forming apparatus 1. However, the technique of the present disclosure can also be applied to a sheet discharging apparatus that discharges sheets from the image forming apparatus 1, or from another apparatus that handles sheets.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-195207, filed on Nov. 25, 2020, No. 2021-026312, filed on Feb. 22, 2021, and No. 2021-156756, filed on Sep. 27, 2021, which are hereby incorporated by reference herein in their entirety.

What is claimed is:

1. A sheet discharging apparatus comprising:

a stacking portion on which a sheet is stacked;

a first conveyance portion that is disposed on a first conveyance path extending toward the stacking portion and that is configured to convey a sheet toward the stacking portion;

a detection portion configured to output a detection signal in response to a sheet that is passing through the first conveyance path;

a second conveyance portion disposed downstream of the first conveyance portion in the first conveyance path and configured to reverse a conveyance direction of a sheet that the second conveyance portion has received from the first conveyance portion and convey the sheet to a second conveyance path, the second conveyance path being a path branched from a portion of the first conveyance path between the first conveyance portion and the second conveyance portion;

a third conveyance portion disposed on the second conveyance path and configured to reverse a conveyance direction of a sheet and convey the sheet; and a control portion configured to control the first conveyance portion, the second conveyance portion, and the third conveyance portion, the control portion being configured to execute a discharge operation by causing the sheet discharging apparatus to:

(1) reverse a conveyance direction of a first sheet conveyed from the first conveyance portion to the second conveyance portion and deliver the first sheet to the third conveyance portion by using the second conveyance portion;

(2) convey the first sheet toward the second conveyance portion by using the third conveyance portion, depending on the detection signal outputted by the detection portion in response to a second sheet that is conveyed following the first sheet; and (3) discharge the first sheet and the second sheet to the stacking portion by using the second conveyance portion in a state where the first sheet and the second sheet are superimposed on each other such that an edge portion of the first sheet in the conveyance direction thereof and an edge portion of the second sheet in a conveyance direction thereof are aligned with each other, wherein the control portion is configured to change a stop position of a leading edge of the first sheet in accordance with a length of the first sheet in the conveyance direction of the first sheet, the leading edge of the first sheet being an edge in a direction from the second conveyance portion toward the third conveyance portion, the stop position being a position at which conveyance of the first sheet by the third conveyance portion is stopped after the first sheet is delivered to the third conveyance portion.

2. The sheet discharging apparatus according to claim 1, wherein, in the discharge operation, the control portion is configured to cause the third conveyance portion to convey the first sheet toward the second conveyance portion at a timing at which a predetermined time has elapsed since the detection portion outputted the detection signal in response to the second sheet, and wherein the predetermined time is preset so that the edge portion of the first sheet and the edge portion of the second sheet are aligned with each other at the second conveyance portion.

3. The sheet discharging apparatus according to claim 1, wherein the stacking portion is projecting toward an outside of an apparatus body of the sheet discharging apparatus, and wherein a sheet that has been discharged to a space above the stacking portion by the second conveyance portion falls onto the stacking portion by gravity, without being conveyed by another conveyance portion other than the second conveyance portion.

4. The sheet discharging apparatus according to claim 1, wherein, in the discharge operation, the control portion is configured to form a sheet bundle constituted by three or more sheets including the first sheet and the second sheet, and cause the second conveyance portion to discharge the sheet bundle to the stacking portion.

5. The sheet discharging apparatus according to claim 1, wherein in a case where the control portion performs a job that discharges a plurality of sheets to the stacking portion, the control portion is configured to repeat the discharge operation so that for each predetermined number of sheets among the plurality of sheets, the predetermined number of sheets are superimposed on each other and discharged to the stacking portion.

6. The sheet discharging apparatus according to claim 5, wherein the control portion is configured to change a number of sheets superimposed on each other in the discharge operation, on a basis of the number of the plurality of sheets to be discharged by the job, such that each sheet among the plurality of sheets is discharged to the stacking portion while the sheet is superimposed on another sheet among the plurality of sheets.

7. The sheet discharging apparatus according to claim 1, wherein the control portion is configured to change the stop position such that a distance from the third conveyance portion to the stop position of the first sheet having a first length is larger than a distance from the third conveyance portion to the stop position of the first sheet having a second length smaller than the first length.

8. The sheet discharging apparatus according to claim 1, wherein the control portion is configured to set the stop position such that a length of a portion of the first sheet that projects from the second conveyance portion toward a side on which the stacking portion is disposed is equal to or smaller than a predetermined value, regardless of a length of the first sheet, in a state where the conveyance of the first sheet by the third conveyance portion is stopped.

9. The sheet discharging apparatus according to claim 1, wherein the stacking portion serves as a first stacking portion, wherein the sheet discharging apparatus further comprises a second stacking portion on which a sheet having been conveyed through the second conveyance path is stacked, and wherein the control portion is configured to perform control for changing the stop position of the first sheet in a case where the first sheet and the second sheet are to be discharged to the first stacking portion, and not to perform the control for changing the stop position of the first sheet in a case where the first sheet and the second sheet are to be discharged to the second stacking portion.

10. A sheet processing apparatus comprising:

the sheet discharging apparatus according to claim 1; and a sheet processing portion configured to perform a process on sheets that have been conveyed through the second conveyance path.

11. The sheet processing apparatus according to claim 10, wherein the control portion is configured to execute a buffering operation by causing the sheet discharging apparatus to (a) superimpose a plurality of sheets, which is conveyed from an outside of the sheet processing apparatus to the first conveyance path while the process is being performed on sheets by the sheet processing portion, on each other by the first conveyance portion, the second conveyance portion, and the third conveyance portion, and (b) convey the plurality of sheets superimposed on each other to the sheet processing portion after the process performed on the sheets by the sheet processing portion is completed, and wherein the control portion executes the discharge operation without executing the buffering operation in a case where a sheet is not to be processed by the sheet processing portion, and executes the buffering operation without executing the discharge operation in a case where a sheet is to be processed by the sheet processing portion.

12. The sheet processing apparatus according to claim 11, wherein the control portion is configured to control the buffering operation such that edge portions of the plurality of sheets superimposed on each other in the buffering operation are shifted from each other in a conveyance direction thereof.

13. The sheet processing apparatus according to claim 11, wherein the sheet processing portion comprises:

an intermediate stacking portion disposed in an apparatus body of the sheet processing apparatus;

a reference member disposed downstream of the intermediate stacking portion in a sheet discharging direction from the second conveyance path toward the intermediate stacking portion;

a moving member configured to move a sheet having been discharged to the intermediate stacking portion, toward the reference member and align the sheet with the reference member; and a pushing member configured to push sheets on which the process has been performed by the sheet processing portion, toward a direction opposite to the discharging direction, wherein the stacking portion serves as a first stacking portion, wherein the sheet processing apparatus further comprises (a) a second stacking portion disposed below the first stacking portion, and (b) a third conveyance path disposed below the first conveyance path and extending from the intermediate stacking portion toward the second stacking portion, and wherein the sheets on which the process has been performed by the sheet processing portion are stacked on the second stacking portion.

14. An image forming system comprising:

an image forming apparatus configured to form an image on a sheet; and the sheet processing apparatus according to claim 10.

* * * * *